US007245297B2

(12) United States Patent
Kimura et al.

(10) Patent No.: US 7,245,297 B2
(45) Date of Patent: Jul. 17, 2007

(54) DISPLAY DEVICE AND ELECTRONIC DEVICE

(75) Inventors: Hajime Kimura, Kanagawa (JP); Jun Koyama, Kanagawa (JP); Masahiko Hayakawa, Kanagawa (JP); Yu Yamazaki, Kanagawa (JP); Yukari Ando, Gifu (JP); Keisuke Miyagawa, Kanagawa (JP); Shunpei Yamazaki, Tokyo (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 36 days.

(21) Appl. No.: 11/131,438

(22) Filed: May 18, 2005

(65) Prior Publication Data

US 2005/0285823 A1 Dec. 29, 2005

(30) Foreign Application Priority Data

May 22, 2004 (JP) ..... 2004-180306

(51) Int. Cl.
*G09G 5/00* (2006.01)

(52) U.S. Cl. ..... 345/214; 345/204; 345/212; 315/169.1; 315/169.3

(58) Field of Classification Search .. 315/169.1–169.3; 345/76, 77, 84, 89, 90, 92, 204, 211, 212, 345/214, 690
See application file for complete search history.

(56) References Cited

U.S. PATENT DOCUMENTS 5,594,463 A 1/1997 Sakamoto
6,473,065 B1 10/2002 Fan
6,479,940 B1 11/2002 Ishizuka
6,501,230 B1 12/2002 Feldman
6,528,951 B2 3/2003 Yamazaki et al.
6,661,180 B2 * 12/2003 Koyama ..... 315/169.3

(Continued)

FOREIGN PATENT DOCUMENTS

EP 1 117 085 A2 7/2001

(Continued)

OTHER PUBLICATIONS

T. Shimoda et al.; "Current Status and Future of Light-Emitting Polymer Display Driven by Poly-Si TFT"; *SID 99 Digest*; pp. 372-375; 1999.

(Continued)

*Primary Examiner*—Haissa Philogene
(74) *Attorney, Agent, or Firm*—Fish & Richardson P.C.

(57) ABSTRACT

The luminance of light emitting elements varies when the characteristics thereof change due to changes in environment temperature and changes with time. It is an object of the present invention to suppress the effect of the change in current value of a light emitting element due to the changes of environment temperature and changes with time. The invention provides a display device provided with a compensation function for the changes in environment temperature and a compensation function for the change with time. The display device of the invention includes a light emitting element, a driving transistor connected to the light emitting element, and a monitoring light emitting element. By using this monitoring light emitting element, an effect of the change of current value of the light emitting element due to the change of environment temperature and change with time can be suppressed.

36 Claims, 18 Drawing Sheets

U.S. PATENT DOCUMENTS

| | | | | |
|---|---|---|---|---|
| 6,753,856 | B1 | 6/2004 | Krah et al. | |
| 6,774,578 | B2 | 8/2004 | Tanada | |
| 6,806,871 | B1 | 10/2004 | Yasue | |
| 6,828,950 | B2 | 12/2004 | Koyama | |
| 6,870,192 | B2 * | 3/2005 | Yamazaki et al. | 257/79 |
| 6,911,781 | B2 | 6/2005 | Yamazaki et al. | |
| 6,963,321 | B2 | 11/2005 | Everitt | |
| 6,995,737 | B2 | 2/2006 | LeChevalier | |
| 7,180,515 | B2 * | 2/2007 | Miyagawa et al. | 345/212 |
| 2001/0020922 | A1 | 9/2001 | Yamazaki et al. | |
| 2001/0030511 | A1 | 10/2001 | Yamazaki et al. | |
| 2001/0033252 | A1 | 10/2001 | Yamazaki et al. | |
| 2002/0033783 | A1 | 3/2002 | Koyama | |
| 2003/0048243 | A1 | 3/2003 | Kwasnick | |
| 2003/0063053 | A1 * | 4/2003 | Yamazaki et al. | 345/82 |
| 2003/0071804 | A1 | 4/2003 | Yamazaki et al. | |
| 2003/0071821 | A1 | 4/2003 | Sundahl et al. | |
| 2003/0132716 | A1 | 7/2003 | Yamazaki et al. | |
| 2003/0209989 | A1 | 11/2003 | Anzai et al. | |
| 2003/0214467 | A1 | 11/2003 | Koyama et al. | |
| 2003/0214521 | A1 | 11/2003 | Osame et al. | |
| 2004/0027320 | A1 | 2/2004 | Ochi et al. | |
| 2004/0100463 | A1 * | 5/2004 | Miyagawa et al. | 345/212 |
| 2004/0150594 | A1 | 8/2004 | Koyama et al. | |
| 2005/0012731 | A1 | 1/2005 | Yamazaki et al. | |
| 2005/0017933 | A1 | 1/2005 | Koyama | |
| 2005/0017963 | A1 | 1/2005 | Yamazaki et al. | |
| 2005/0017964 | A1 | 1/2005 | Yamazaki et al. | |
| 2006/0022206 | A1 | 2/2006 | Havakawa et al. | |
| 2006/0038804 | A1 * | 2/2006 | Hayakawa et al. | 345/204 |

FOREIGN PATENT DOCUMENTS

| | | |
|---|---|---|
| EP | 1 148 466 A2 | 10/2001 |
| JP | 61-261921 | 11/1986 |
| JP | 11-305722 | 11/1999 |
| JP | 2000-347622 | 12/2000 |
| JP | 2001-035655 | 2/2001 |
| JP | 2001-134197 | 5/2001 |
| JP | 2001-272968 | 10/2001 |
| JP | 2001-331144 | 11/2001 |
| JP | 2002-123217 | 4/2002 |
| JP | 2002-175041 | 6/2002 |
| JP | 2002-175046 | 6/2002 |
| JP | 2002-278514 | 9/2002 |
| JP | 2002-333861 | 11/2002 |
| JP | 2002-351403 | 12/2002 |
| JP | 2003-323159 | 11/2003 |

OTHER PUBLICATIONS

Tatsuya Shimoda et al.; "High Resolution Light Emitting Polymer Display Driven by Low Temperature Polysilicon Thin Film Transistor with Integrated Driver"; *Asia Display '98*; pp. 217-220; 1998.

Chang Wook Han et al.; "Green OLED with low temperature poly Si TFT"; *EuroDisplay '99*; pp. 27-30; 1999.

* cited by examiner 112
112
112
111
100

140
115
115

121
120
119
118

117
123
122
terminal portion
pixel portion

DISPLAY DEVICE AND ELECTRONIC DEVICE

BACKGROUND OF THE INVENTION

1. Field of the Invention

The present invention relates to a display device and to a television device having a light emitting element.

2. Description of the Related Art

In recent years, a display device having a light emitting element represented by an EL (Electro Luminescence) element has been developed and expected to be widely used by taking advantages as a self-luminous type device, such as high image quality, wide viewing angle, thin design, and lightweight. A light emitting element has a property that the luminance thereof is in proportion to a current value. Therefore, there is a display device which employs a constant current drive in which a constant current is supplied to the light emitting element in order to obtain an accurate gray scale (for example, see Patent Document 1).

[Patent Document 1]

Japanese Patent Laid-Open No. 2003-323159

SUMMARY OF THE INVENTION

A light emitting element has a property that a resistance value (internal resistance) changes in accordance with the ambient temperature (hereinafter referred to as the environment temperature). In specific, with a room temperature set as a normal temperature, when the temperature becomes higher than the normal temperature, the resistance value decreases while the resistance value increases when the temperature becomes lower than the normal temperature. Accordingly, when the temperature rises, a luminance higher than desired is obtained as a current value increases. Thus, in the case of applying the same voltage at a lower temperature, a luminance lower than desired is obtained as a current value decreases. Such a property of a light emitting element is shown in a graph of a relationship between voltage-current (hereinafter also referred to as V-I) characteristics of a light emitting element and temperature (see FIG. 17A). Further, a light emitting element has a property that a current value thereof decreases with time. In specific, a resistance value increases in accordance with the degradation of light emitting element when light emission and non-light emission time is accumulated. Accordingly, in the case of applying the same voltage after the light emission and non-light emission time is accumulated, a luminance lower than desired is obtained as a current value decreases. Such a property of a light emitting element is shown in a graph of a relationship between V-I characteristics of a light emitting element and time (see FIG. 17B).

Due to the aforementioned properties of a light emitting element, luminance thereof varies when the environment temperature changes and changes time occur. In view of the aforementioned, the invention suppresses the influence of changes in current value of a light emitting element due to changes in environment temperature and changes with time.

The invention provides a display device provided with a compensation function for the changes in environment temperature and a compensation function for the changes with time (hereinafter also collectively referred to as a compensation function).

The invention provides a display device having a first transistor and a second transistor. A drain terminal of the first transistor and a drain terminal of the second transistor are electrically connected. A source terminal of the first transistor and a first electrode for supplying a current to a first light emitting element are electrically connected. A source terminal of the second transistor and a first electrode for supplying a current to a second light emitting element are electrically connected. The other electrode for supplying a current to the second light emitting element and an input terminal of an amplifier circuit are electrically connected. The second electrode for supplying a current to the second light emitting element and a current source circuit are electrically connected. A second electrode for supplying a current to the first light emitting element and an output terminal of the amplifier circuit are electrically connected.

The invention provides a display device having a first transistor and a second transistor. A source terminal of the first transistor and a first electrode for supplying a current to the first light emitting element are electrically connected. A source terminal of the second transistor and a first electrode for supplying a current to the second light emitting element are electrically connected. A gate terminal of the second transistor and a drain terminal of the second transistor are electrically connected. The drain terminal of the second transistor and an input terminal of an amplifier circuit are electrically connected. The drain terminal of the second transistor and a current source circuit are electrically connected. A second electrode for supplying a current to the first light emitting element and a second electrode for supplying a current to the second light emitting element are electrically connected. A gate terminal of the first transistor and an output terminal of a video signal generating circuit are electrically connected. An output terminal of the amplifier circuit and an input terminal of the video signal generating circuit are electrically connected.

The invention provides a display device having a first transistor and a second transistor. A source terminal of the first transistor and a first electrode for supplying a current to a first light emitting element are electrically connected. A source terminal of the second transistor and a first electrode for supplying a current to the second light emitting element are electrically connected. A drain terminal of the second transistor and an input terminal of an amplifier circuit are electrically connected. The drain terminal of the second transistor and a current source circuit are electrically connected. A second electrode for supplying a current to the first light emitting element and a second electrode for supplying a current to the second light emitting element are electrically connected. An output terminal of the amplifier circuit and a drain terminal of the first transistor are electrically connected.

The invention provides a display device having a first transistor, a second transistor, a first light emitting element, and a second light emitting element. A drain terminal of the first transistor and a drain terminal of the second transistor are electrically connected. A source terminal of the first transistor and one electrode of the first light emitting element are electrically connected. A source terminal of the second transistor and one electrode of the second light emitting element are electrically connected. The other electrode of the second light emitting element and an input terminal of a voltage follower circuit are electrically connected. The other electrode of the second light emitting element and a current source circuit are electrically connected. The other electrode of the first light emitting element and an output terminal of the voltage follower circuit are electrically connected.

The invention provides a display device having a first transistor, a second transistor, a first light emitting element, and a second light emitting element. A source terminal of the first transistor and one electrode of the first light emitting element are electrically connected. A source terminal of the second transistor and one electrode of the second light emitting element are electrically connected. A gate terminal of the second transistor and a drain terminal of the second transistor are electrically connected. The drain terminal of the second transistor and an input terminal of a voltage follower circuit are electrically connected. The drain terminal of the second transistor and a current source circuit are electrically connected. The other electrode of the first light emitting element and the other electrode of the second light emitting element are electrically connected. A gate terminal of the first transistor and an output terminal of a video signal generating circuit are electrically connected. An output terminal of the voltage follower circuit and an input terminal of the video signal generating circuit are electrically connected.

The invention provides a display device having a first transistor, a second transistor, a first light emitting element, and a second light emitting element. A source terminal of the first transistor and one electrode of the first light emitting element are electrically connected. A source terminal of the second transistor and one electrode of the second light emitting element are electrically connected. A drain terminal of the second transistor and an input terminal of a voltage follower circuit are electrically connected. The drain terminal of the second transistor and a current source circuit are electrically connected. The other electrode of the first light emitting element and the other electrode of the second light emitting element are electrically connected. An output terminal of the voltage follower circuit and a drain terminal of the first transistor are electrically connected.

In the aforementioned configurations, a channel forming region of each transistor can be formed of an amorphous semiconductor or a semi-amorphous semiconductor. That is, a thin film transistor (hereinafter also referred to as a TFT) formed of an amorphous semiconductor film or a semi-amorphous semiconductor film can be used.

The invention provides a television device provided with any one of the aforementioned configurations. The television device is a thin device of which pixels are formed using an electroluminescence material.

The invention can provide a display device which suppresses the effect of variations in current values of light emitting elements caused by the change of environment temperature and the change with time.

DETAILED DESCRIPTION OF THE INVENTION

Although the invention will be described by way of example with reference to the accompanying drawings, it is to be understood that various changes and modifications will be apparent to those skilled in the art. Therefore, unless such changes and modifications depart from the scope of the invention, they should be construed as being included therein. Therefore, the embodiment modes and embodiments are not intended as a definition of the limits of the invention.

EMBODIMENT MODE 1

Figure 1A:
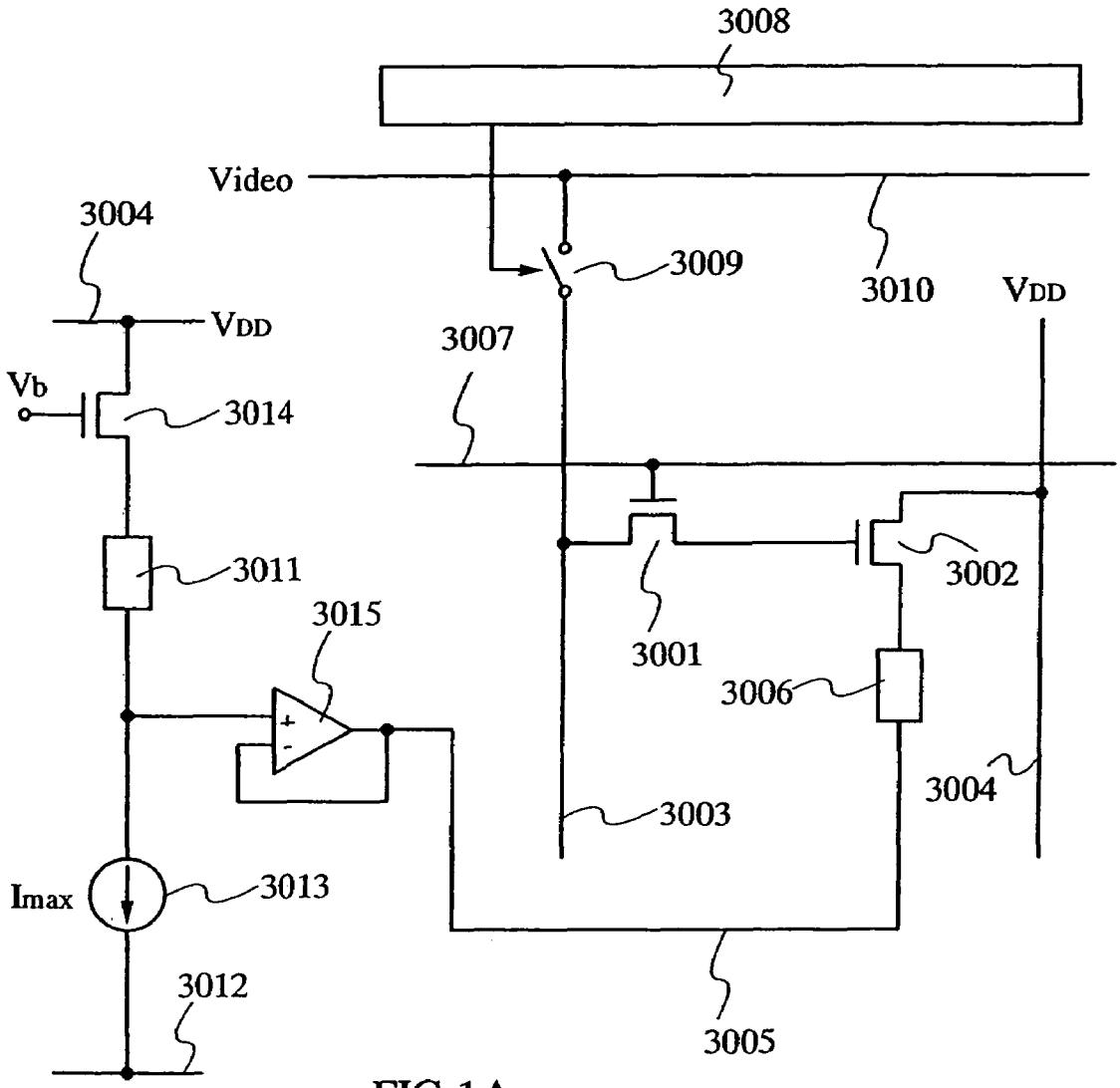
FIGS. 1A and 1B are circuit diagrams showing a configuration of a display device according to one embodiment mode.

FIG. 1A shows a circuit configuration. A pixel includes a selecting transistor 3001, a driving transistor 3002, and a light emitting element 3006. A source signal line 3003 to which a video signal is inputted and a gate terminal of the driving transistor 3002 are connected through the selecting transistor 3001. A gate terminal of the selecting transistor 3001 is connected to a gate signal line 3007. The driving transistor 3002 and the light emitting element 3006 are connected between a first power supply line 3004 and a second power supply line 3005. A current flows from the first power supply line 3004 to the second power supply line 3005. The light emitting element 3006 emits light in accordance with the size of current supplied thereto.

An analog switch 3009 provided between a video line 3010 to which a video signal is inputted and the source signal line 3003 is controlled using a shift register 3008. A video signal supplied to the source signal line 3003 is inputted to the gate electrode of the driving transistor 3002. A current flows to the driving transistor 3002 and the light emitting element 3006 in accordance with the video signal.

It is to be noted that a capacitor may be provided for holding a video signal inputted to the gate terminal of the driving transistor 3002. In that case, a capacitor may be provided between the gate terminal of the driving transistor 3002 and the drain terminal of the driving transistor 3002. Alternatively, a capacitor may be provided between the gate terminal of the driving transistor 3002 and a source terminal of the driving transistor 3002. Otherwise, a capacitor may be provided between the gate terminal of the driving transistor 3002 and another wiring (a dedicated wiring, a gate signal line of a pixel of preceding stage and the like). A capacitor is not necessarily provided when gate capacitance of the driving transistor 3002 is large enough. It is to be noted that the driving transistor 3002 and the selecting transistor 3001 are N-channel transistors, however, the invention is not limited to this.

In such a pixel configuration, when potentials of the first power supply line 3004 and the second power supply line 3005 are fixed, current keeps flowing to the light emitting element 3006 and the driving transistor 3002, thereby characteristics thereof degrade. The light emitting element 3006 and the driving transistor 3002 change their characteristics according to the temperature. In specific, V-I characteristics shift when current keeps flowing to the light emitting element 3006. That is to say, a resistance value of the light emitting element 3006 increases, thus a current value supplied thereto becomes small even with the same voltage applied. Moreover, light emission efficiency decreases and the luminance decreases even with the same current supplied. As a temperature behavior, V-I characteristics of the light emitting element 3006 shift when the temperature falls, thereby a resistance value of the light emitting element 3006 becomes high.

Similarly, when current keeps flowing to the driving transistor 3002, a threshold voltage thereof becomes high. Therefore, a current becomes small even with the same gate voltage applied. A current value flowing changes therethrough according to the temperature as well.

In view of this, a monitoring circuit is used for correcting the effect of the aforementioned degradation and changes. In this embodiment mode, by controlling the potential of the second power supply line 3005, degradation of the light emitting element 3006 and temperature change and the changes in current value of the driving transistor 3002 due to degradation are corrected A configuration of a monitoring circuit is described. A monitoring driving transistor 3014, a monitoring light emitting element 3011, and a monitoring current source 3013 are connected between the first power supply line 3004 and a third power supply line 3012. An input terminal of the voltage follower circuit 3015 is connected at a connection of the monitoring light emitting element 3011 and the monitoring current source 3013. An output terminal of the voltage follower circuit 3015 is connected to the second power supply line 3005. Therefore, the potential of the second power supply line 3005 is controlled by an output of the voltage follower circuit 3015.

Next, an operation of the monitoring circuit is described. First, the monitoring current source 3013 supplies the light emitting element 3006 with a current required for the light emitting element 3006 to emit light at the highest gray scale level. A current value at this time is referred to as Imax. A potential Vb which is the same as that of the video signal inputted to the pixel (a gate terminal of the driving transistor 3002) when the light emitting element 3006 emits light at the highest gray scale level is applied to a gate terminal of the monitoring driving transistor 3014.

Then, a voltage high enough to supply a current having the size of Imax is applied as a voltage between a gate and a source (hereinafter also referred to as a gate-source voltage) of the monitoring driving transistor 3014. That is to say, a source potential of the monitoring driving transistor 3014 becomes high enough to supply a current having the size of Imax. Even if a threshold voltage of the monitoring driving transistor 3014 changes due to degradation, temperature, and the like, the gate-source voltage (source potential) changes accordingly, thereby becomes an optimum level. Accordingly, the effect of variation in a threshold voltage (degradation, temperature change and the like) can be corrected.

Similarly, a voltage high enough to supply a current having the size of Imax is applied to both terminals of the monitoring light emitting element 3011. Even if V-I characteristics of the monitoring light emitting element 3011 change due to degradation, temperature, and the like, voltages of the both terminals of the monitoring light emitting element 3011 change accordingly, thereby become an optimum level. Accordingly, the effect of variation in the monitoring light emitting element 3011 (degradation, temperature change and the like) can be corrected.

A sum of a voltage applied to the monitoring driving transistor 3014 and a voltage applied to the monitoring light emitting element 3011 is inputted to the input terminal of the voltage follower circuit 3015. Therefore, a potential of the output terminal of the voltage follower circuit 3015, that is the second power supply line 3005 is corrected by the monitoring circuit. Therefore, the changes of the light emitting element 3006 and the driving transistor 3002 due to degradation and temperature are also corrected.

It is to be noted that the voltage follower circuit is not limited to this. That is, any circuit can be applied as long as it outputs a voltage according to an input current. The voltage follower circuit is one of amplifier circuits, however, the invention is not limited to this. A circuit may be configured by using any one or a plurality of an operational amplifier, a bipolar transistor, and a MOS transistor in combination.

It is preferable that the monitoring light emitting element 3011 and the monitoring driving transistor 3014 be formed over the same substrate at the same time as the light emitting element 3006 and the driving transistor 3002 by the same manufacturing method. This is because the same correction cannot be performed if characteristics differ between the monitoring element and the transistor provided in a pixel.

The description has been made on the case where a potential as high as a video signal inputted to a pixel (the gate terminal of the driving transistor 3002) when the light emitting element 3006 emits light at the highest gray scale level is applied to a gate terminal of the monitoring driving transistor 3014 and a current required for the light emitting element 3006 to emit light at the highest gray scale level is supplied to the monitoring current source 3013 when emits. However, the invention is not limited to this.

The monitoring light emitting element 3011 and the monitoring driving transistor 3014 degrade more than the light emitting element 3006 and the driving transistor 3002 which are provided in a pixel if the potential based on the highest gray scale level is applied. Therefore, a potential outputted from the voltage follower circuit 3015 is more corrected. Therefore, the monitoring circuit may be set so as to degrade at the same rate as an actual pixel. For example, when the light emission efficiency of the entire screen is 30%, the monitoring circuit may operate at a gray scale level corresponding to a luminance of 30%.

In specific, a potential as high as a video signal inputted to a pixel (the gate terminal of the driving transistor 3002) when the light emitting element 3006 emits light at a gray scale level corresponding to a luminance of 30% may be applied to the gate terminal of the monitoring driving transistor 3014. A current having the size to be supplied to the light emitting element 3006 when the light emitting element 3006 emits light at a gray scale level corresponding to the luminance of 30% may be supplied to the monitoring current source 3013.

Figure 1B:
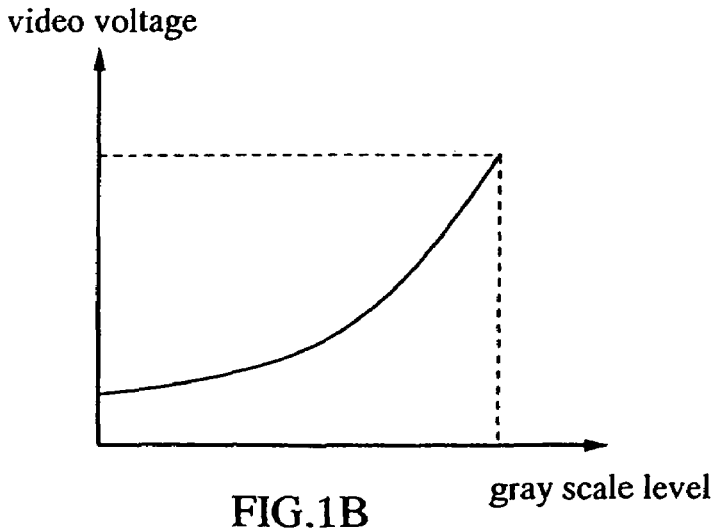

It is to be noted that a voltage of a video signal is to be increased as shown in FIG. 1B for increasing the gray scale level of the light emitting element when the light emitting element drives in the saturation region. In this embodiment mode, a potential of the second power supply line 3005 is corrected which is connected to one electrode of the light emitting element 3006. Therefore, a voltage of a video signal (video voltage) for increasing the gray scale level of the light emitting element is not required to be corrected.

It is to be noted that a potential which is more corrected is outputted when the monitoring circuit operates in accordance with the highest gray scale level, however, it is preferable that the monitoring circuit operate in accordance with the highest gray scale level since image persistence (luminance variation due to the variations in degradation rates among pixels) becomes less noticeable. Therefore, it is preferable that the monitoring circuit operate in accordance with the highest gray scale level.

It is to be noted that the driving transistor 3002 may operate only in the saturation region, both in the saturation region and the linear region, or only in the linear region.

In the case where the driving transistor 3002 operates only in the linear region, the driving transistor 3002 operates mostly as a switch. Accordingly, variations in characteristics due to degradation, temperature change and the like of the driving transistor 3002 do not affect much. However, the effect of variations in characteristics due to degradation, temperature change and the like of the light emitting element 3006 is corrected. In the case where the driving transistor 3002 operates only in the linear region, whether a current is supplied to the light emitting element 3006 is often controlled digitally. In that case, a time gray scale method, an area gray scale method and the like are often used in combination for performing a multi-gray scale display.

EMBODIMENT MODE 2

In this embodiment mode, description is made on the case of performing correction using a video signal.

Figure 2A:
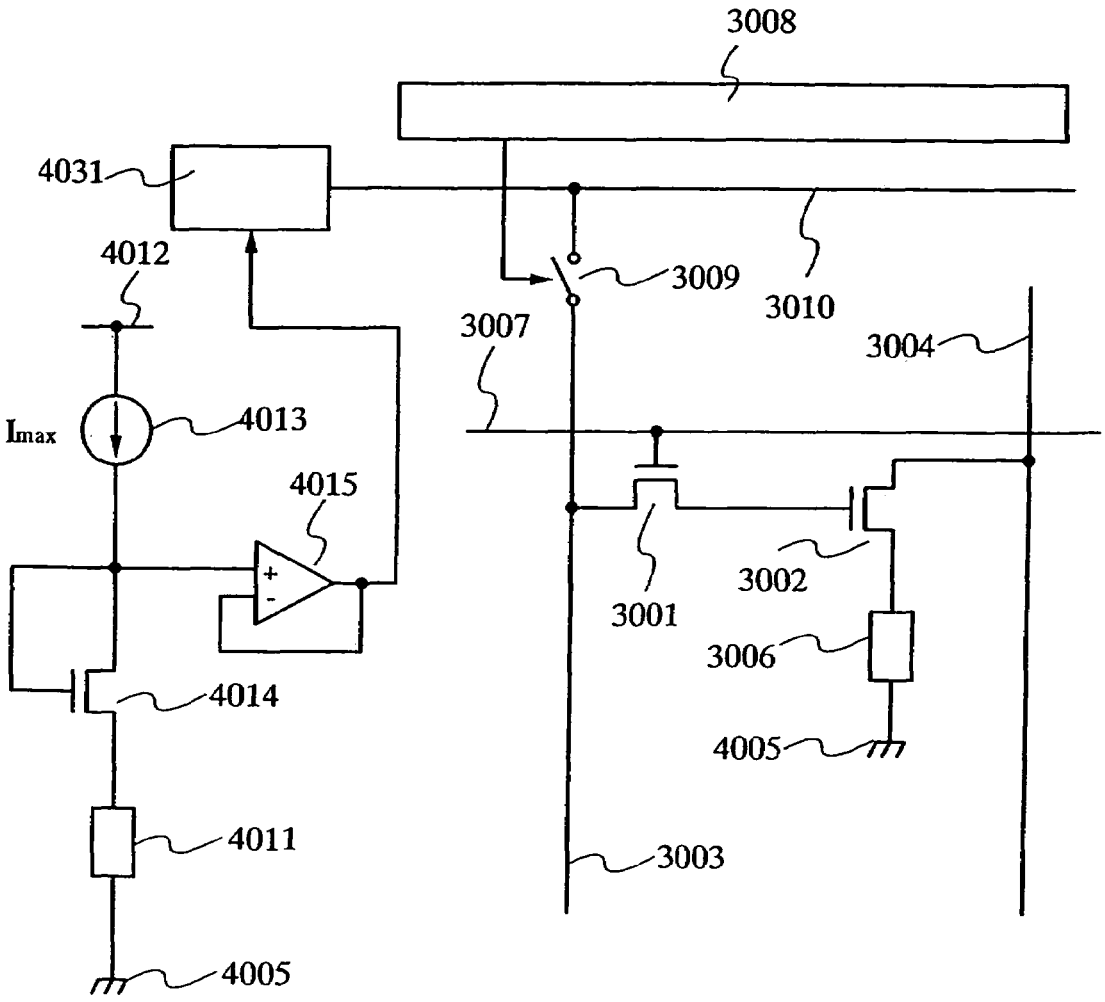
FIGS. 2A and 2B are circuit diagrams showing a configuration of a display device according to one embodiment mode.

FIG. 2A shows a circuit configuration. A pixel includes the selecting transistor 3001, the driving transistor 3002, and the light emitting element 3006. The source signal line 3003 to which a video signal is inputted and the gate terminal of the driving transistor 3002 are connected through the selecting transistor 3001. The gate terminal of the selecting transistor 3001 is connected to the gate signal line 3007. The driving transistor 3002 and the light emitting element 3006 are connected between the first power supply line 3004 and a second power supply line 4005. A current flows from the first power supply line 3004 to a second power supply line 4005. The light emitting element 3006 emits light in accordance with the current supplied thereto.

The analog switch 3009 provided between the video line 3010 to which a video signal is inputted and the source signal line 3003 is controlled using the shift register 3008. A video signal supplied to the source signal line 3003 is inputted to the gate electrode of the driving transistor 3002. A current flows to the driving transistor 3002 and to the light emitting element 3006 in accordance with the video signal.

A video signal generating circuit 4031 is connected as a circuit for supplying a video signal to the video line 3010. The video signal generating circuit 4031 has a function to process a video signal for correcting variations of the driving transistor 3002 and the light emitting element 3006 due to degradation, temperature change and the like.

In such a pixel configuration, when potentials of the first power supply line 3004 and the second power supply line 4005 are fixed, current keeps flowing to the light emitting element 3006 and the driving transistor 3002, thereby characteristics thereof degrade. The light emitting element 3006 and the driving transistor 3002 change their characteristics according to the temperature.

In specific, V-I characteristics shift when current keeps flowing to the light emitting element 3006. That is to say, a resistance value of the light emitting element 3006 increases, thus a current value supplied thereto becomes small even with the same voltage applied. Moreover, light emission efficiency decreases and the luminance decreases even with the same current supplied. As temperature characteristics, V-I characteristics of the light emitting element 3006 shift when the temperature falls, thereby a resistance value of the light emitting element 3006 becomes high.

Similarly, when current keeps flowing to the driving transistor 3002, a threshold voltage thereof becomes high. Therefore, a current becomes small even with the same gate voltage applied. A current value flowing therethrough changes according to the temperature as well.

In view of this, a monitoring circuit is used for correcting the aforementioned effect of degradation and variation. In this embodiment mode, by controlling a voltage of the video signal, variations of the light emitting element 3006 and the driving transistor 3002 due to degradation and temperature are corrected.

First, a configuration of a monitoring circuit is described. A monitoring current source 4013, monitoring driving transistor 4014, and a monitoring light emitting element 4011 are connected between the first power supply line 4012 and the second power supply line 4005. An input terminal of a voltage follower circuit 4015 is connected at a connection of the monitoring current source 4013 and the monitoring light emitting element 4011. An output terminal of the voltage follower circuit 4015 is connected to the video signal generating circuit 4031. Therefore, the voltage of the video signal is controlled by an output of the voltage follower circuit 4015.

Next, an operation of the monitoring circuit is described. First, the monitoring current source 4013 supplies to the light emitting element 3006 a current required for the light emitting element 3006 to emit light at the highest gray scale level. A current value at this time is referred to as Imax. A gate terminal of the monitoring driving transistor 4014 is connected to a drain terminal of the monitoring driving transistor 4014.

Then, a voltage high enough to supply a current having the size of Imax is applied as a gate-source voltage of the monitoring driving transistor 4014. That is to say, a source potential of the monitoring driving transistor 4014 becomes high enough to supply a current having the size of Imax. As the drain terminal is connected to the gate terminal, the drain potential becomes high enough to supply a current having the size of Imax. Even if a threshold voltage of the monitoring driving transistor 4014 changes due to degradation, temperature, and the like, the gate-source voltage (source potential and drain potential) changes accordingly, thereby becomes an optimum level. Accordingly, the effect of variation of a threshold voltage (degradation, temperature change and the like) can be corrected.

Similarly, a voltage high enough to supply a current having the size of Imax is applied to both terminals of the monitoring light emitting element 4011. Even if V-I characteristics of the monitoring light emitting element 4011 change due to degradation, temperature, and the like, voltages of the both terminals of the monitoring light emitting element 4011 change accordingly, thereby become an optimum level. Accordingly, an effect of variation of the monitoring light emitting element 4011 (degradation, temperature change and the like) can be corrected.

A sum of a voltage applied to the monitoring driving transistor 4014 and a voltage applied to the monitoring light emitting element 4011 is inputted to the input terminal of the voltage follower circuit 4015. Therefore, a potential of the output terminal of the voltage follower circuit 4015, that is a potential of a video signal outputted from the video signal generating circuit 4031 is corrected by the monitoring circuit. Therefore, the variations of the light emitting element 3006 and the driving transistor 3002 due to degradation and temperature change are corrected.

It is to be noted that the voltage follower circuit is not limited to this. That is, any circuit can be applied as long as it outputs a voltage according to an input current. The voltage follower circuit is one of amplifier circuits, however, the invention is not limited to this. A circuit may be configured by using any one or a plurality of an operational amplifier, a bipolar transistor, and a MOS transistor in combination.

It is preferable that the monitoring light emitting element 4011 and the monitoring driving transistor 4014 be formed over the same substrate at the same time as the light emitting element and the driving transistor 3002 by the same manufacturing method. This is because the same correction cannot be performed if characteristics differ between the monitoring element and the transistor provided in a pixel.

The description has been made on the case where a potential as high as a video signal inputted to a pixel (the gate terminal of the driving transistor 3002) when the light emitting element 3006 emits light at the highest gray scale level is applied to the gate terminal of the monitoring driving transistor 4014 and a current required for the light emitting element 3006 to emit light at the highest gray scale level is supplied to the monitoring current source 4013. However, the invention is not limited to this.

The monitoring light emitting element 4011 and the monitoring driving transistor 4014 degrade more than the light emitting element 3006 and the driving transistor 3002 that are provided in a pixel if the potential based on the highest gray scale level is applied. Therefore, a potential outputted from the voltage follower circuit 4015 is more corrected. Therefore, the monitoring circuit may be set so as to degrade at the same rate as an actual pixel. For example, when the light emission efficiency of the entire screen is 30%, the monitoring circuit may operate at a gray scale level corresponding to a luminance of 30%.

Figure 2B:
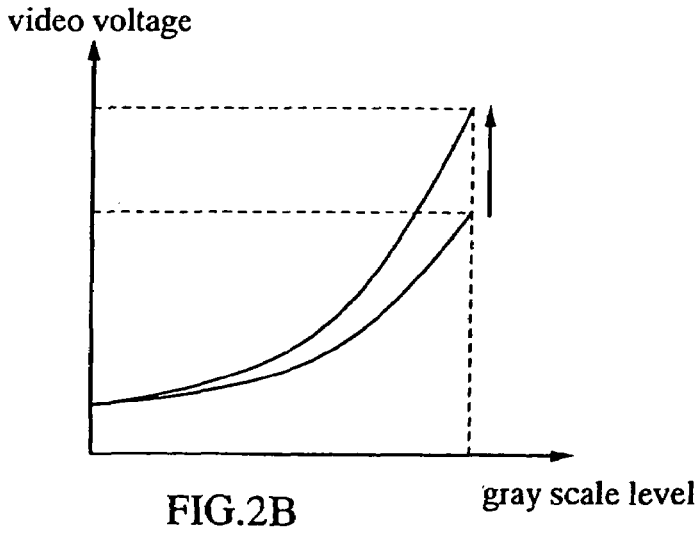

It is to be noted that a voltage of a video signal is to be increased as shown in FIG. 2B for increasing the gray scale level of the light emitting element when the light emitting element operates in the saturation region. In this embodiment mode, a potential of the gate terminal of the driving transistor 3002 is corrected. Therefore, a desired luminance of a light emitting element can be displayed by correcting a voltage of a video signal (a video voltage) to be as shown in FIG. 2B in accordance with the change in characteristics of the light emitting element 3006.

In specific, a current of a desired size to be supplied to the light emitting element 3006 when the light emitting element 3006 emits light at a gray scale level corresponding to a luminance of 30% may be supplied to the monitoring current source 4013. The video signal generating circuit 4031 may output a video signal accordingly.

It is to be noted that a potential which is more corrected is outputted when the monitoring circuit operates in accordance with the highest gray scale level, however, it is preferable that the monitoring circuit operate in accordance with the highest gray scale level since image persistence (luminance variation due to the variation of degradation among pixels) becomes less noticeable. Therefore, it is preferable that the monitoring circuit operate in accordance with the highest gray scale level.

It is to be noted that the driving transistor 3002 may operate only in the saturation region, or both in the saturation region and the linear region.

EMBODIMENT MODE 3

In this embodiment mode, description is made on the case of performing correction using a potential of the first power supply line.

Figure 3:
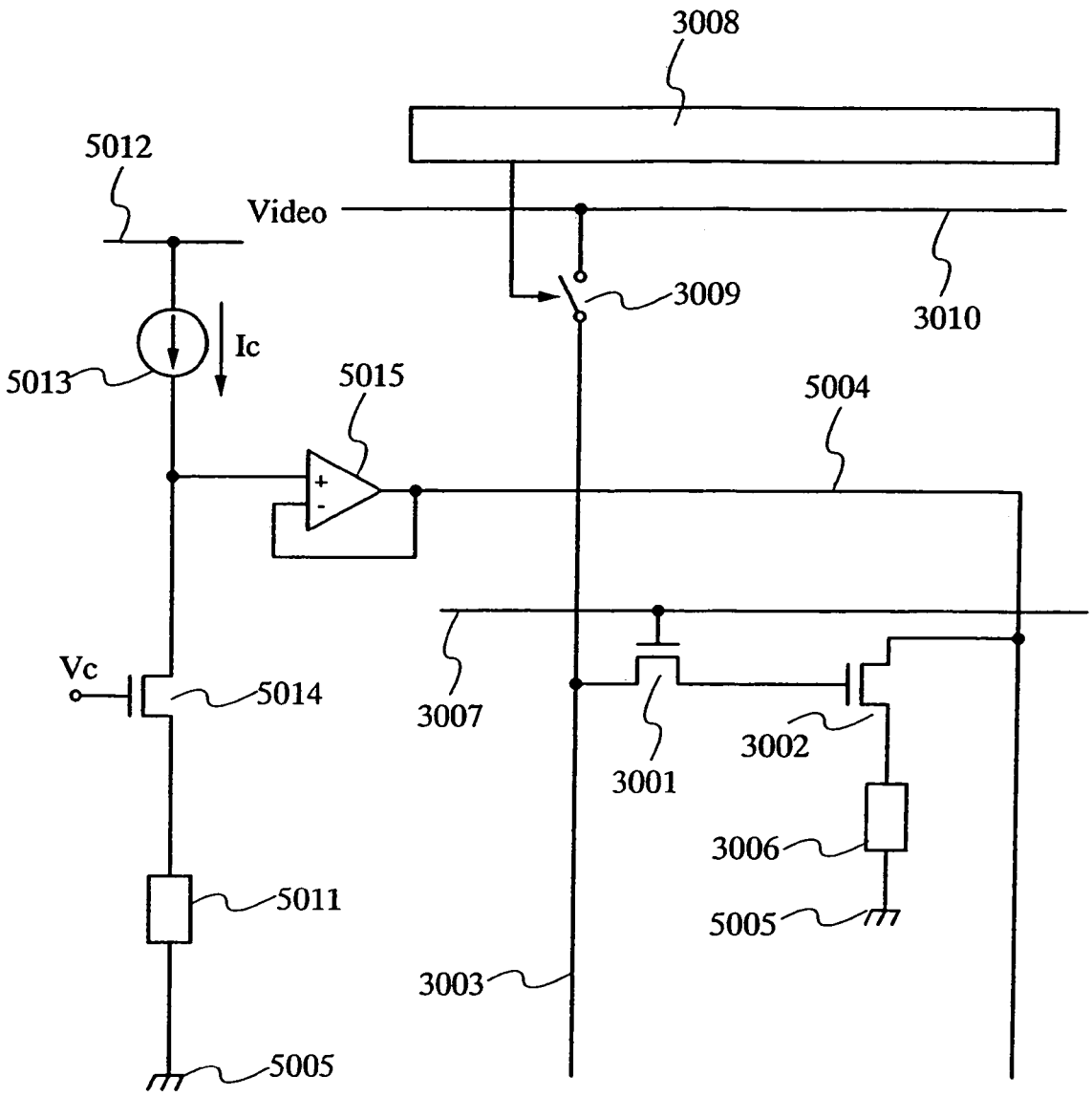
FIG. 3 is a circuit diagram showing a configuration of a display device according to one embodiment mode.

FIG. 3 shows a circuit configuration. A pixel includes the selecting transistor 3001, the driving transistor 3002, and the light emitting element 3006. The source signal line 3003 to which a video signal is inputted and the gate terminal of the driving transistor 3002 are connected through the selecting transistor 3001. The gate terminal of the selecting transistor 3001 is connected to the gate signal line 3007. The driving transistor 3002 and the light emitting element 3006 are connected between a first power supply line 5004 and a second power supply line 5005. A current flows from the first power supply line 5004 to the second power supply line 5005. The light emitting element 3006 emits light in accordance with the size of current supplied thereto.

The analog switch 3009 provided between the video line 3010 to which a video signal is inputted and the source signal line 3003 is controlled using the shift register 3008. A video signal supplied to the source signal line 3003 is inputted to the gate electrode of the driving transistor 3002. A current flows to the driving transistor 3002 and the light emitting element 3006 in accordance with the video signal size.

In such a pixel configuration, when potentials of the first power supply line 5004 and the second power supply line 5005 are fixed, characteristics of the light emitting element 3006 and the driving transistor 3002 degrade when current keeps flowing therethrough. The light emitting element 3006 and the driving transistor 3002 change their characteristics according to the temperature.

In specific, V-I characteristics shift when current keeps flowing to the light emitting element 3006. That is to say, a resistance value of the light emitting element 3006 increases, thus a current value supplied thereto becomes small even with the same voltage applied. Moreover, light emission efficiency decreases and the luminance decreases even with the same current supplied. As temperature characteristics, V-I characteristics of the light emitting element 3006 shift when the temperature falls, thereby a resistance value of the light emitting element 3006 becomes high.

Similarly, when current keeps flowing to the driving transistor 3002, a threshold voltage thereof becomes high. Therefore, a current becomes small even with the same gate voltage applied. A current value flowing therethrough changes according to the temperature as well.

In view of this, a monitoring circuit is used for correcting the aforementioned degradation effect of and variation. In this embodiment mode, by controlling the potential of the first power supply line 5004, variations of the light emitting element 3006 and the driving transistor 3002 due to degradation and temperature are corrected.

A configuration of a monitoring circuit is described. A monitoring current source 5013, a monitoring driving transistor 5014, and a monitoring light emitting element 5011 are connected between a first power supply line 5012 and the second power supply line 5005. An input terminal of a voltage follower circuit 5015 is connected at a connection of the monitoring current source 5013 and the monitoring light emitting element 5011. An output terminal of the voltage follower circuit 5015 is connected to the first power supply line 5004. Therefore, the potential of the first power supply line 5004 is controlled by an output of the voltage follower circuit 5015.

Next, an operation of the monitoring circuit is described. First, the monitoring current source 5013 supplies to the light emitting element 3006 a current required for the light emitting element 3006 to emit light at the highest gray scale level. A current value at this time is referred to as Imax. A potential Vc as high as a video signal inputted to a pixel (the gate terminal of the driving transistor 3002) when the light emitting element 3006 emits light at the highest gray scale level is applied to the gate terminal of the monitoring driving transistor 5014.

Then, a voltage high enough to supply a current having the size of Imax is applied as a gate-source voltage or between the drain and the source (hereinafter referred to as drain-source) of the monitoring driving transistor 5014. That is to say, a source potential and a drain potential of the monitoring driving transistor 5014 become high enough to supply a current having the size of Imax. Even if a threshold voltage of the monitoring driving transistor 5014 changes due to degradation, temperature, and the like, the gate-source voltage (source potential) and the drain-source voltage (drain potential) change accordingly, thereby becomes an optimum level. Accordingly, the effect of variation of a threshold voltage (degradation, temperature change and the like) can be corrected.

Similarly, a voltage high enough to supply a current having the size of Imax is applied to both terminals of the monitoring light emitting element 5011. Even if V-I characteristics of the monitoring light emitting element 5011 change due to degradation, temperature, and the like, voltages of the both terminals of the monitoring light emitting element 5011 change accordingly, thereby become an optimum level. Accordingly, the effect of variation of the monitoring light emitting element 5011 (degradation, temperature change and the like) can be corrected.

A sum of a voltage applied to the monitoring driving transistor 5014 and a voltage applied to the monitoring light emitting element 5011 is inputted to the input terminal of the voltage follower circuit 5015. Therefore, a potential of the output terminal of the voltage follower circuit 5015, that is a potential of the first power supply line 5004 is corrected by the monitoring circuit. Therefore, the variations of the light emitting element 3006 and the driving transistor 3002 due to degradation and temperature change are corrected.

It is to be noted that the voltage follower circuit is not limited to this. That is, any circuit can be applied as long as it outputs a voltage according to an input current. The voltage follower circuit is one of amplifier circuits, however, the invention is not limited to this. A circuit may be configured by using any one or a plurality of an operational amplifier, a bipolar transistor, and a MOS transistor in combination.

It is preferable that the monitoring light emitting element 5011 and the monitoring driving transistor 5014 be formed over the same substrate at the same time as the light emitting element 3006 and the driving transistor 3002 by the same manufacturing method. This is because the same correction cannot be performed if characteristics differ between the monitoring element and the transistor provided in a pixel.

There is often a period when a current is not supplied to the light emitting element 3006 and the driving transistor 3002 which are disposed in a pixel. Therefore, when a current keeps flowing to the monitoring light emitting element 5011 and the monitoring driving transistor 5014, they degrade more than the light emitting element 3006 and the driving transistor 3002. Accordingly, a potential outputted from the voltage follower circuit 5015 is more corrected. Therefore, the monitoring circuit may be set so as to degrade at the same rate as an actual pixel. For example, when the light emission ratio of the entire display is 30%, a current may be set to flow to the monitoring light emitting element 5011 and the monitoring driving transistor 5014 only in a period corresponding to a luminance of 30%. At that time, there is a period when a current is not supplied to the monitoring light emitting element 5011 and the monitoring driving transistor 5014, however, it is required that a voltage be applied from the output terminal of the voltage follower circuit 5015 without change. In order to realize this, a capacitor is provided at the input terminal of the voltage follower circuit 5015 for holding a potential of the time when a current is supplied to the monitoring light emitting element 5011 and the monitoring driving transistor 5014.

It is to be noted that a potential which is more corrected is outputted when the monitoring circuit operates in accordance with the highest gray scale level, however, it is preferable that the monitoring circuit operate in accordance with the highest gray scale level since image persistence (luminance variation due to the variation in degradation among pixels) becomes less noticeable. Therefore, it is preferable that the monitoring circuit operate in accordance with the highest gray scale level.

It is preferable that the driving transistor 3002 operate in the linear region. This is because a drain potential of the driving transistor 3002 changes for correcting the potential of the first power supply line 5004 in this embodiment mode. When the driving transistor 3002 operates in the saturation region, a current flowing through the driving transistor 3002 does not change much even if the drain potential thereof is changed. On the other hand, when the driving transistor 3002 operates in the linear region, a current value changes when the drain potential changes, thus a correction has a major effect. Therefore, it is preferable that the driving transistor 3002 operate in the linear region.

When the driving transistor 3002 operates only in the saturation region, it operates mostly as a switch. Accordingly, variations in characteristics of the driving transistor 3002 due to degradation, temperature and the like do not affect much. However, the effect of the variations in characteristics of the light emitting element 3006 due to degradation, temperature and the like are corrected. When the driving transistor 3002 operates only in the linear region, whether a current is supplied to the light emitting element 3006 is often controlled digitally. In that case, a time gray scale method, an area gray scale method and the like are often used in combination for performing a multi-gray scale display.

EMBODIMENT MODE 4

Figure 4A:
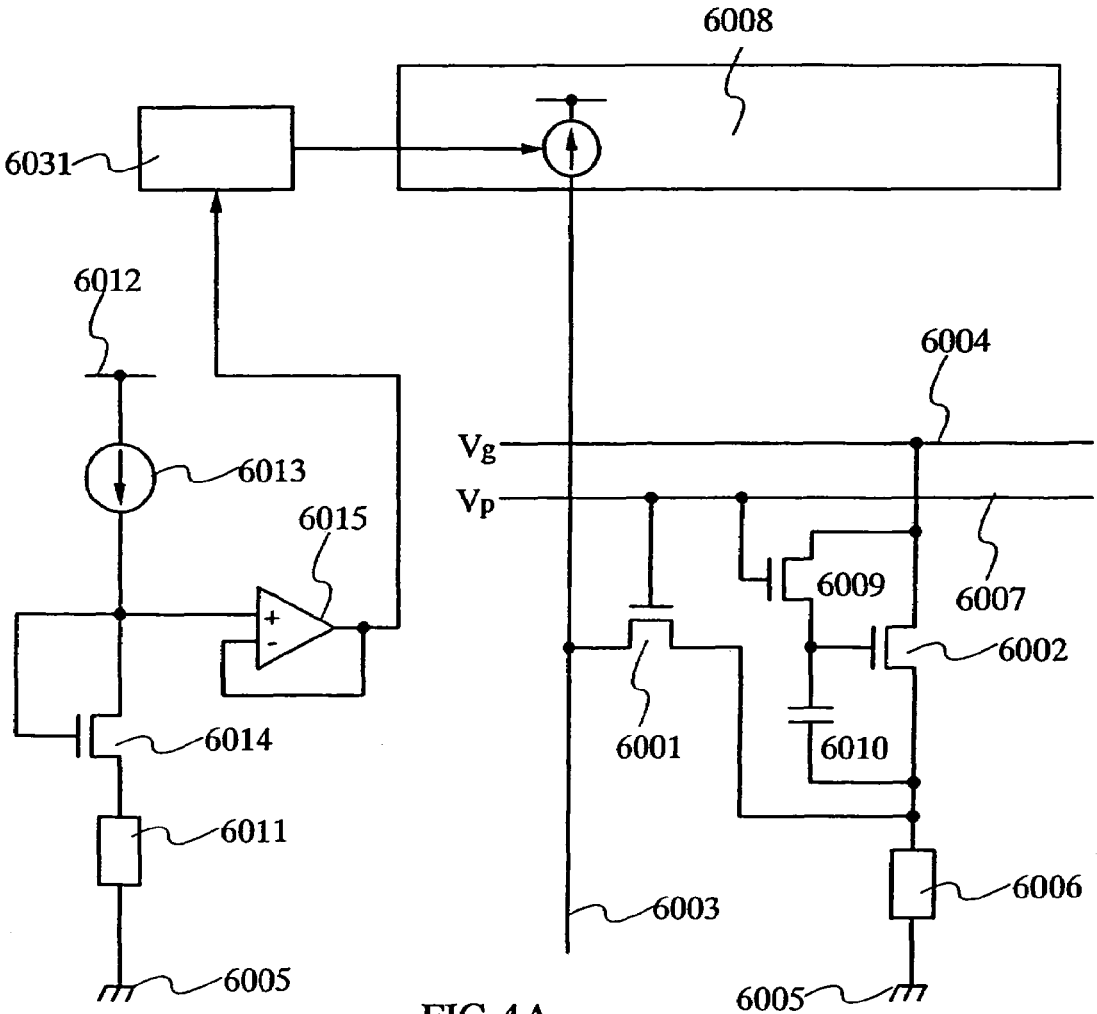
FIGS. 4A and 4B are circuit diagrams showing a configuration of a display device according to one embodiment mode.

FIG. 4A shows a circuit configuration. A pixel includes a selecting transistor 6001, a driving transistor 6002, a holding transistor 6009, a capacitor 6010, and a light emitting element 6006. A source signal line 6003 to which a video signal is inputted and a source terminal of the driving transistor 6002 are connected through the selecting transistor 6001. A gate terminal of the selecting transistor 6001 is connected to a gate signal line 6007. The driving transistor 6002 and the light emitting element 6006 are connected between a first power supply line 6004 and a second power supply line 6005. A current flows from the first power supply line 6004 to the second power supply line 6005. The light emitting element 6006 emits light in accordance with the size of current supplied thereto. The capacitor 6010 is provided between the gate and the source of the driving transistor 6002 while the holding transistor 6009 is connected between the drain and the source of the driving transistor 6002. A gate terminal of the holding transistor 6009 is connected to the gate signal line 6007.

A signal driver circuit includes a video current source circuit 6008. The video current source circuit 6008 supplies to a pixel a current of the size corresponding to a video signal. When the gate signal line 6007 is selected, a video signal is supplied to the source signal line 6003 and inputted to the driving transistor 6002. At this time, as the potential of the first power supply line 6004 is changed, a current does not flow to the light emitting element 6006 because of the potential of the second power supply line 6005. In accordance with the magnitude of the video signal, a gate-source voltage of a desired level of the driving transistor 6002 is accumulated in the capacitor 6010. After that, the gate signal line 6007 becomes a non-selected state, thereby the charge accumulated in the capacitor 6010 is held. Therefore, even when a drain potential and a source potential of the driving transistor 6002 changes, the gate-source voltage of the driving transistor 6002 does not change. Then, the potential of the first power supply line 6004 turns back and a current of the size corresponding to the video signal flows to the driving transistor 6002, and then to the light emitting element 6006.

Figure 4B:
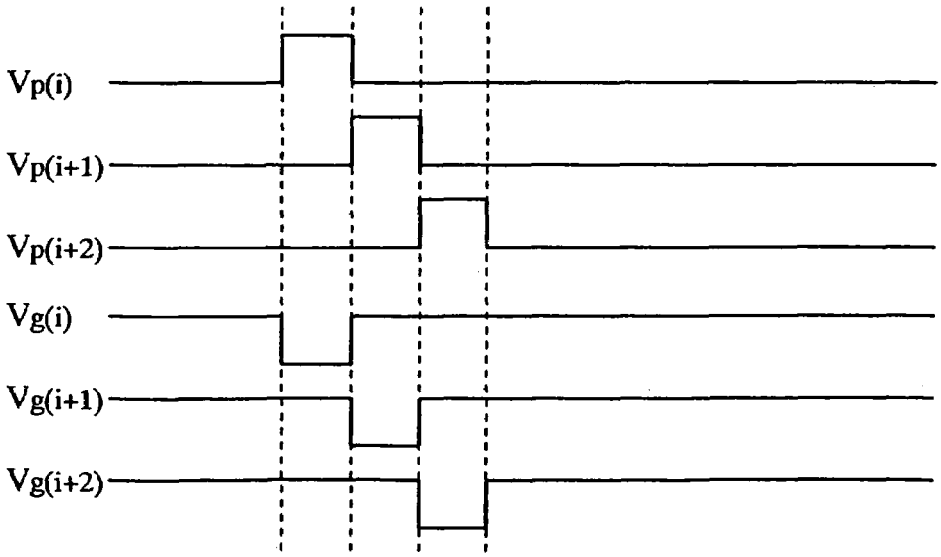

FIG. 4B shows a timing chart of potentials of the gate signal line 6007 and the first power supply line 6004. First, a signal for turning on the selecting transistor 6001 and the holding transistor 6009 is inputted from an i-th gate signal line Vp (i). At the same time, a signal of which potential is an inversion of that of the gate signal line Vp (i) is inputted to an i-th first power supply line Vg (i). Accordingly, a gate-source voltage high enough to flow to the driving transistor 6002 a current corresponding to the magnitude of the video signal is accumulated in the capacitor 6010. At the same time, a current supplied by the driving transistor 6002 being on can be controlled not to be supplied to the light emitting element 6006 by a relationship with the potential of the second power supply line 6005. At this time, by making the potential of the second power supply line 6005 higher, a current can be controlled not to be supplied to the light emitting element 6006. In that case, a gate-source voltage for flowing to the driving transistor 6002 a current corresponding to the magnitude of the video signal of the video current source circuit 6008 is accumulated in the capacitor 6010 of all the pixels in an address period (writing period), thereby all pixels may emit light at once in a sustain period (light emission period). Similar operations are performed in an (i+1)-th gate signal line Vp (i+1), (i+1)th first power supply line Vg (i+1), and an (i+2)-th gate signal line Vp (i+2), and an (i+2)-th first power supply line Vg (i+2).

It is to be noted that the driving transistor 6002 and the selecting transistor 6001 are N-channel transistors. However, the invention is not limited to this.

In such a pixel configuration, when a current keeps flowing to the light emitting element 6006, characteristics thereof degrade. Moreover, the characteristics of the light emitting element 6006 change due to temperature of the light emitting element or around the light emitting element.

In specific, when a current keeps flowing to the light emitting element 6006, a light emission efficiency decreases and the luminance decreases even with the same current supplied.

In view of this, the aforementioned effect of degradation and variation is corrected by using a monitoring circuit. In this embodiment mode, by controlling the size of current of a video signal, variations of the light emitting element 6006 due to degradation and temperature are corrected.

A configuration of the monitoring circuit is described. A monitoring current source 6013, a monitoring driving transistor 6014, and a monitoring light emitting element 6011 are connected between a first power supply line 6012 and the second power supply line 6005. An input terminal of a voltage follower circuit 6015 is connected at a connection of the monitoring current source 6013 and the monitoring driving transistor 6014. An output terminal of the voltage follower circuit 6015 is connected to an input terminal of a video signal generating circuit 6031 which controls the size of current outputted by the video current source circuit 6008. Accordingly, the size of current outputted by the video current source circuit 6008 is controlled by the output of the voltage follower circuit 6015.

Next, an operation of the monitoring circuit is described. First, the monitoring current source 6013 supplies to the light emitting element 6006 a current required for the light emitting element 6006 to emit light at the highest gray scale level. A current value at this time is referred to as Imax.

Then, a voltage high enough to supply a current having the size of Imax is applied as a gate-source voltage of the monitoring driving transistor 6014 of which gate terminal and drain terminal are connected. That is to say, a source potential and a drain potential of the monitoring driving transistor 6014 become high enough to supply a current having the size of Imax.

Similarly, a voltage high enough to supply a current having the size of Imax is applied to both terminals of the monitoring light emitting element 6011. Even if V-I characteristics of the monitoring light emitting element 6011 change due to degradation, temperature, and the like, voltages of the both terminals of the monitoring light emitting element 6011 change accordingly, thereby become an optimum level. Accordingly, an effect of variation of the monitoring light emitting element 6011 (degradation, temperature change and the like) can be corrected.

A sum of a voltage applied to the monitoring driving transistor 6014 and a voltage applied to the monitoring light emitting element 6011 is inputted to the input terminal of the voltage follower circuit 6015. Therefore, the size of the current outputted from the output terminal of the voltage follower circuit 6015, that is the video current source circuit 6008 is corrected by the monitoring circuit. Therefore, the variations of the light emitting element 6006 due to degradation and temperature change are also corrected.

It is to be noted that the voltage follower circuit is not limited to this. That is, any circuit can be applied as long as it outputs a voltage according to an input current. The voltage follower circuit is one of amplifier circuits, however, the invention is not limited to this. A circuit may be configured by using any one or a plurality of an operational amplifier, a bipolar transistor, and a MOS transistor in combination.

It is preferable that the monitoring light emitting element 6011 and the monitoring driving transistor 6014 be formed over the same substrate at the same time as the light emitting element 6006 and the driving transistor 6002 by the same manufacturing method. This is because the same correction cannot be performed if characteristics differ between the monitoring element and the transistor provided in a pixel.

The description has been made on the case where the monitoring current source 6013 is supplied with a current required for the light emitting element 6006 to emit light at the highest gray scale level, however, the invention is not limited to this.

In accordance with the highest gray scale level, the monitoring light emitting element 6011 degrade more than the light emitting element 6006 which is disposed in a poxel. Accordingly, a potential outputted from the voltage follower circuit 6015 is more corrected. Therefore, the monitoring circuit may be set so as to degrade at the same rate as an actual pixel. For example, when an average light emission ratio of the entire display is 30%, the monitoring circuit may operate according to the gray scale level corresponding to the luminance of 30%. In specific, a current of a desired size to be supplied to the light emitting element 6006 may be supplied to the monitoring current source 6013 when the light emitting element 6006 emits light at a gray scale level corresponding to the luminance of 30%. The video signal generating circuit 6031 may output a video signal accordingly.

It is to be noted that a potential which is more corrected is outputted when the monitoring circuit operates in accordance with the highest gray scale level, however, it is preferable that the monitoring circuit operate in accordance with the highest gray scale level since image persistence (luminance variation due to the variation in degradation among pixels) becomes less noticeable. Therefore, it is preferable that the monitoring circuit operate in accordance with the highest gray scale level.

It is to be noted that the driving transistor 6002 may operate only in the saturation region, both in the saturation region and the linear region, or only in the linear region.

Figure 18:
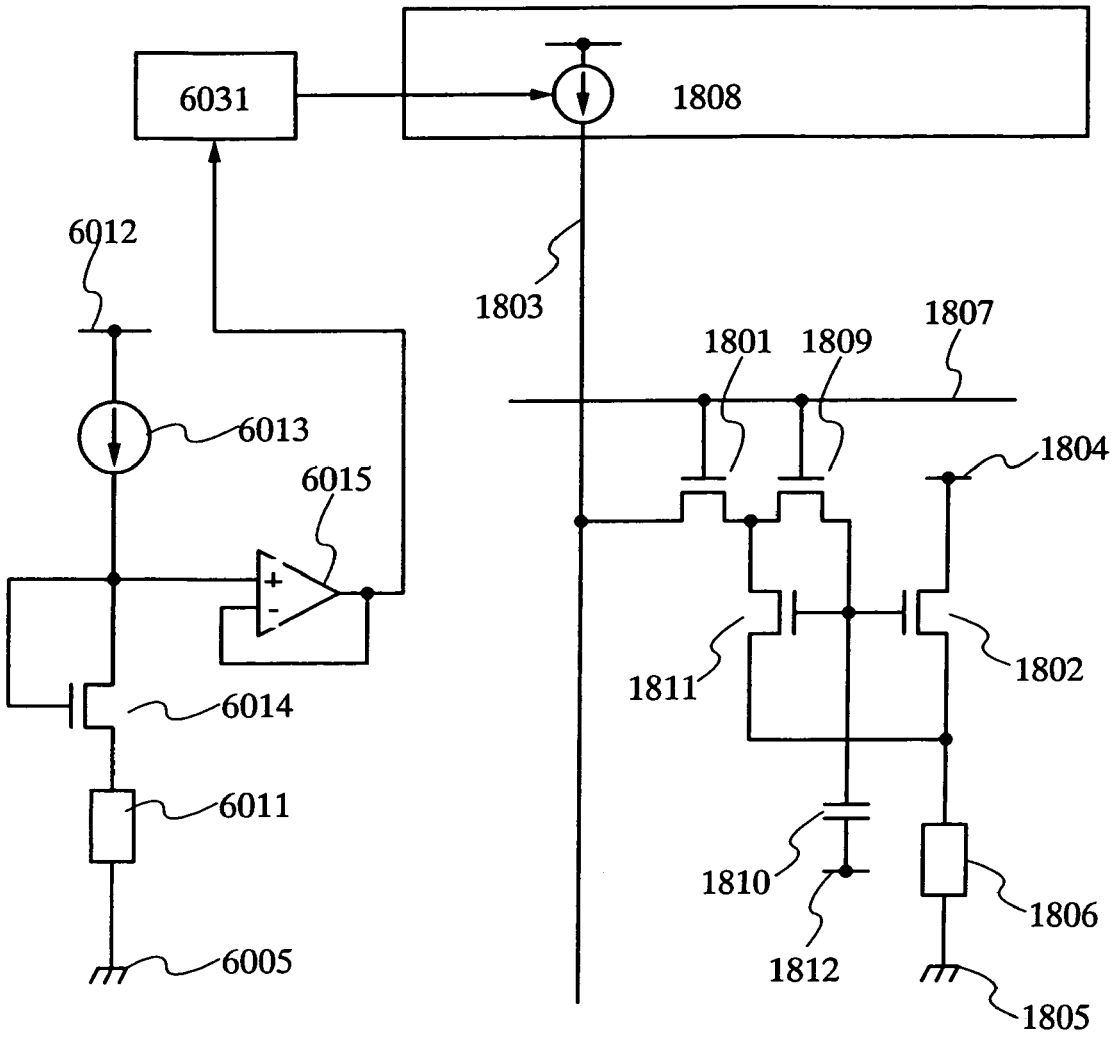
FIG. 18 is a circuit diagram showing a configuration of a display device according to one embodiment mode.
Figure 17A:
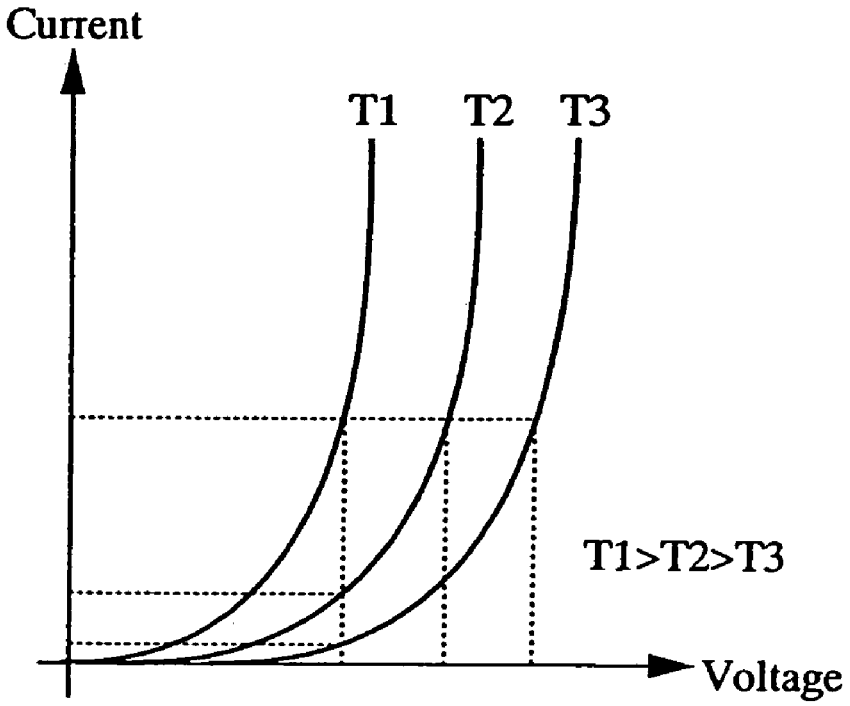
FIGS. 17A and 17B are graphs each showing a relationship between V-I characteristics of a light emitting element and temperature.
Figure 17B:
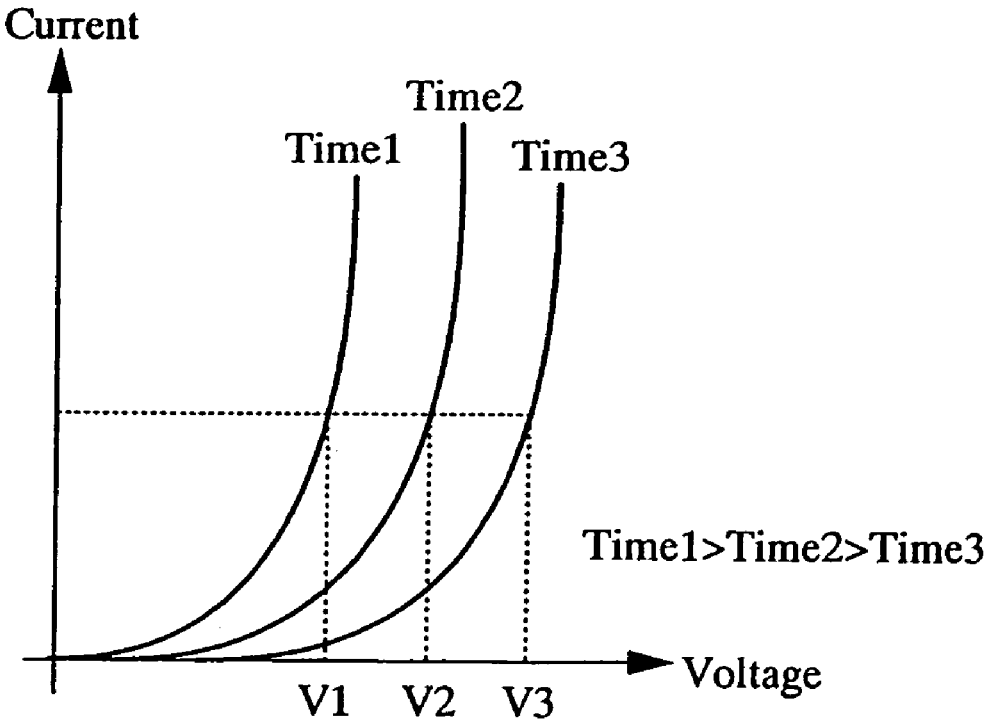

It is to be noted that the pixel configuration is not limited to FIG. 4. In FIG. 4, a current having a size according to a video signal is supplied to the pixel. Even when current characteristics of the driving transistor 6002 vary, a current having a size according to the video signal can be supplied to the light emitting element 6006. That is, the variations in current characteristics of the driving transistor 6002 are corrected. FIG. 18 shows another pixel configuration as an example in which variations in current characteristics of a driving transistor are corrected by supplying to a pixel a current having a size according to a video signal.

A pixel includes a selecting transistor 1801, a driving transistor 1802, a conversion transistor 1811, a holding transistor 1809, a capacitor 1810, and a light emitting element 1806. A source signal line 1803 to which a video signal is inputted and a gate terminal of the driving transistor 1802 are connected through the selecting transistor 1801 and the holding transistor 1809. The selecting transistor 1801 is provided between the source signal line 1803 and a drain terminal of the conversion transistor 1811. Gate terminals of the selecting transistor 1801 and the holding transistor 1809 are connected to a gate signal line 1807. The driving transistor 1802 and the light emitting element 1806 are connected between a first power supply line 1804 and a second power supply line 1805. A current flows from the first power supply line 1804 to the second power supply line 1805. The light emitting element 1806 emits light according to the current flowing between the first power supply line 1804 and the second power supply line 1805. A capacitor 1810 is connected to a gate terminal of the driving transistor 1802 and holds a gate potential thereof. The capacitor 1810 is connected between the gate terminal of the driving transistor 1802 and a wiring 1812, however, the invention is not limited to this. The capacitor 1810 may be connected between the gate and source of the driving transistor 1802. The holding transistor 1809 is connected between a drain and gate of the conversion transistor 1811. The driving transistor 1802 and the conversion transistor 1811 form a current mirror in which the gate terminals thereof are connected to each other and source terminals thereof are connected to each other.

A signal line driver circuit is provided with a video current source circuit 1808. The video current source circuit 1808 supplies to a pixel a current having a size according to a video signal. A video signal supplied to the source signal line 6003 when the gate signal line 1807 is selected is inputted to the conversion transistor 1811. A gate potential of the conversion transistor 1811 having a required level is accumulated in the capacitor 1810. After that, the gate signal line 1807 becomes a non-selected state, thus a charge accumulated in the capacitor 1810 is stored. As the driving transistor 1802 and the conversion transistor 1811 form a current mirror, a current having a size according to the current supplied to the conversion transistor 1811 flows to the driving transistor 1802. As a result, a current having a size according to the video signal flows to the driving transistor 1802 and then to the light emitting element 1806. Here, by designing current capacity (a ratio W/L of channel width W to a channel length L) of the driving transistor 1802 smaller than that of the conversion transistor 1811, a larger current can be supplied to the conversion transistor 1811. As a result, a larger current can be supplied from the video current source circuit 1808 to the pixel. As a result, a write speed of a signal to the pixel can be increased.

EMBODIMENT MODE 5

Figure 5A:
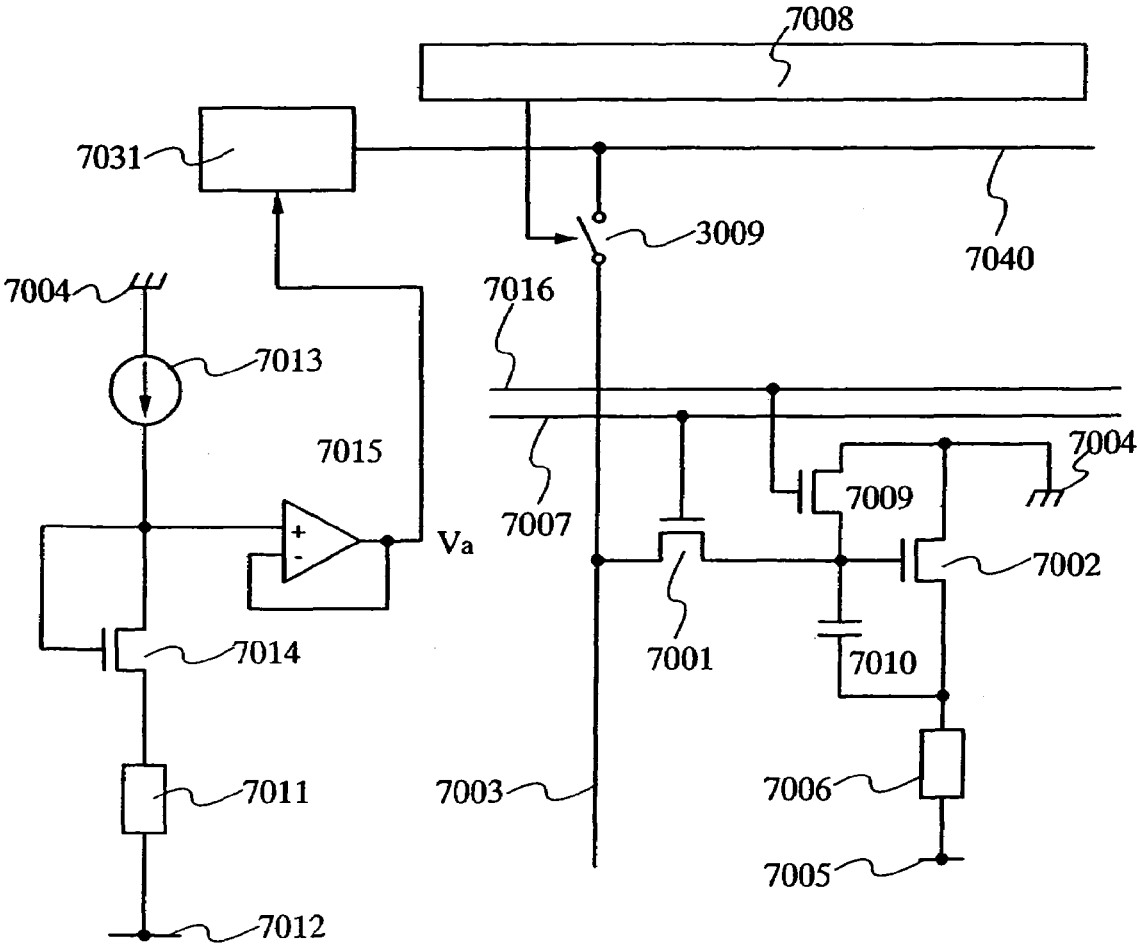
FIGS. 5A and 5B are circuit diagrams showing a configuration of a display device according to one embodiment mode.

FIG. 5A shows a circuit configuration. A pixel includes a selecting transistor 7001, a driving transistor 7002, a holding transistor 7009, a capacitor 7010, and a light emitting element 7006. A source signal line 7003 to which a video signal is inputted and a gate terminal of the driving transistor 7002 are connected through the selecting transistor 7001. A gate terminal of the selecting transistor 7001 is connected to a gate signal line 7007. The driving transistor 7002 and the light emitting element 7006 are connected between a first power supply line 7004 and a second power supply line 7005. A current flows from the first power supply line 7004 to the second power supply line 7005. The light emitting element 7006 emits light in accordance with the size of current supplied thereto. The capacitor 7010 is provided between the gate and the source of the driving transistor 7002 while the holding transistor 7009 is connected between the drain and source of the driving transistor 7002. A gate terminal of the holding transistor 7009 is connected to a second gate signal line 7016.

In the circuit configuration shown in FIG. 5A, the holding transistor 7009 is turned on according to a signal inputted from the second gate signal line 7016. A gate-source voltage of the driving transistor 7002 according to a threshold voltage thereof is accumulated in the capacitor 7010. Accordingly, variations in threshold voltage of each driving transistor can be corrected in advance. It is to be noted that a charge higher than the threshold voltage may be accumulated in the capacitor in advance by making the potential of the second power supply line higher only for a moment.

By using a shift register 7008, the analog switch 3009 provided between a video line 7040 to which a video signal is inputted and the source signal line 7003 is controlled. The video signal inputted to the source signal line 7003 is inputted to the gate electrode of the driving transistor 7002. A current flows to the driving transistor 7002 in accordance with the magnitude of the video signal and is supplied to the light emitting element 7006.

It is to be noted that the driving transistor 7002 and the selecting transistor 7001 are N-channel transistors. However, the invention is not limited to this.

A video signal generating circuit 7031 is connected as a circuit for supplying a video signal to the video line 7040. The video signal generating circuit 7031 has a function to process the video signal for correcting variations of the driving transistor 7002 and the light emitting element 7006 due to degradation, temperature and the like.

In such a pixel configuration, when potentials of the first power supply line 7004 and the second power supply line 7005 are fixed in the case where the light emitting element 7006 emits light, current keeps flowing to the light emitting element 7006 and the driving transistor 7002, thereby characteristics thereof degrade. The light emitting element 7006 and the driving transistor 7002 change their characteristics according to the temperature.

In specific, V-I characteristics shift when current keeps flowing to the light emitting element 7006. That is to say, a resistance value of the light emitting element 7006 increases, thus a current value supplied thereto becomes small even with the same voltage applied. Moreover, light emission efficiency decreases and the luminance decreases even with the same current supplied. As temperature characteristics, V-I characteristics of the light emitting element 7006 shift when the temperature falls, thereby a resistance value of the light emitting element 7006 becomes high.

Similarly, when current keeps flowing to the driving transistor 7002, a threshold voltage thereof becomes high. Therefore, a current flowing therethrough becomes small even with the same gate voltage applied. A current value flowing therethrough changes according to the temperature as well.

In view of this, a monitoring circuit is used for correcting the aforementioned effect of degradation and variation. In this embodiment mode, by controlling the potential of the video signal, variations of the light emitting element 7006 and the driving transistor 7002 due to degradation and temperature are corrected.

A configuration of a monitoring circuit is described. A monitoring current source 7013, a monitoring driving transistor 7014, and a monitoring light emitting element 7011 are connected between the first power supply line 7004 and a second power supply line 7012. An input terminal of a voltage follower circuit 7015 is connected at a connection of the monitoring current source 7013 and the monitoring driving transistor 7014. An output terminal of the voltage follower circuit 7015 is connected to the video signal generating circuit 7031. Therefore, the voltage of the video signal is controlled by the output of the voltage follower circuit 7015.

Next, an operation of the monitoring circuit is described. First, the monitoring current source 7013 supplies to the light emitting element 7006 a current required for the light emitting element 7006 to emit light at the highest gray scale level. A current value at this time is referred to as Imax.

Then, a voltage high enough to supply a current having the size of Imax is applied as a gate-source voltage of the monitoring driving transistor 7014 of which gate terminal and drain terminal are connected. That is to say, a source potential and a drain potential of the monitoring driving transistor 7014 become high enough to supply a current having the size of Imax. Even if a threshold voltage of the monitoring driving transistor 7014 changes due to degradation, temperature, and the like, the gate-source voltage (source potential and drain potential) changes accordingly, thereby becomes an optimum level. Accordingly, the effect of variation of a threshold voltage (degradation, temperature change and the like) can be corrected.

Similarly, a voltage high enough to supply a current having the size of Imax is applied to both terminals of the monitoring light emitting element 7011. Even if V-I characteristics of the monitoring light emitting element 7011 change due to degradation, temperature, and the like, voltages of the both terminals of the monitoring light emitting element 7011 change accordingly, thereby become an optimum level. Accordingly, the effect of variation of the monitoring light emitting element 7011 (degradation, temperature change and the like) can be corrected.

A sum of a voltage applied to the monitoring driving transistor 7014 and a voltage applied to the monitoring light emitting element 7011 is inputted to the input terminal of the voltage follower circuit 7015. Therefore, a potential of the output terminal of the voltage follower circuit 7015, that is a potential of a video signal is corrected by the monitoring circuit. Therefore, the variations of the light emitting element 7006 and the driving transistor 7002 due to degradation and temperature change are corrected.

It is to be noted that the voltage follower circuit is not limited to this. That is, any circuit can be applied as long as it outputs a voltage according to an input current. The voltage follower circuit is one of amplifier circuits, however, the invention is not limited to this. A circuit may be configured by using any one or a plurality of an operational amplifier, a bipolar transistor, and a MOS transistor in combination.

It is preferable that the monitoring light emitting element 7011 and the monitoring driving transistor 7014 be formed over the same substrate at the same time as the light emitting element 7006 and the driving transistor 7002 by the same manufacturing method. This is because the same correction cannot be performed if characteristics differ between the monitoring element and the transistor provided in a pixel.

The description has been made on the case where the monitoring current source 7013 supplies to the light emitting element 7006 a current required for the light emitting element 7006 to emit light at the highest gray scale level, however, the invention is not limited to this.

In accordance with the highest gray scale level, the monitoring light emitting element 7011 and the monitoring driving transistor 7014 degrade more than the light emitting element 7006 and the driving transistor 7002 provided in a pixel. Accordingly, a potential outputted from the voltage follower circuit 7015 is more corrected. Therefore, the monitoring circuit may be set so as to degrade at the same rate as an actual pixel. For example, when an average light emission ratio of the entire display is 30%, the monitoring circuit may operate according to the gray scale level corresponding to the luminance of 30%.

In specific, a current of a desired size to be supplied to the light emitting element 7006 may be supplied to the monitoring current source 7013 when the light emitting element 7006 emits light at a gray scale level corresponding to the luminance of 30%. The video signal generating circuit 7031 may output a video signal accordingly.

Figure 5B:
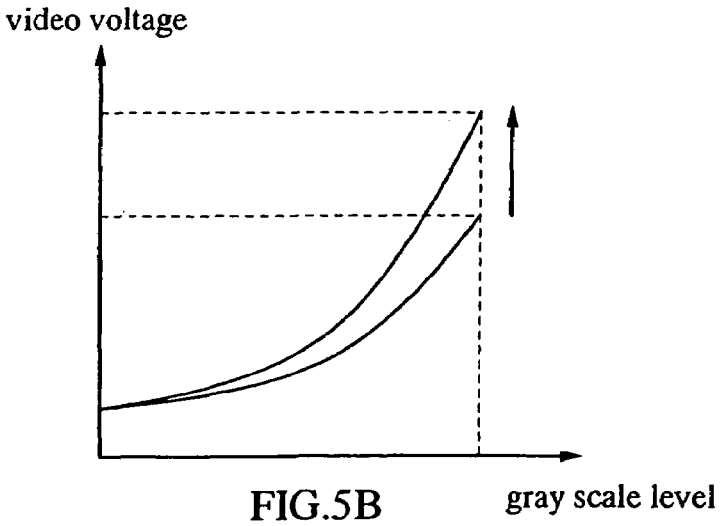

In order to increase the gray scale level of a light emitting element, a voltage of a video signal is to be increased as shown in FIG. 5B when the light emitting element operates in the saturation region. In this embodiment mode, a potential of a gate terminal of the driving transistor 7002 is corrected. Accordingly, by correcting the voltage of the video signal (video voltage) in accordance with change in characteristics of the light emitting element 7006, a desired luminance can be obtained.

It is to be noted that a potential which is more corrected is outputted when the monitoring circuit operates in accordance with the highest gray scale level, however, it is preferable that the monitoring circuit operate in accordance with the highest gray scale level since image persistence (luminance variation due to the variation in degradation among pixels) becomes less noticeable. Therefore, it is preferable that the monitoring circuit operate in accordance with the highest gray scale level.

It is to be noted that the driving transistor 7002 may operate only in the saturation region, both in the saturation region and the linear region, or only in the linear region.

When the driving transistor 7002 operates only in the saturation region, it operates mostly as a switch. Accordingly, it is not likely to be affected by the variations in characteristics of the driving transistor 7002 due to degradation, temperature and the like do not affect much. However, the effect of the variations of characteristics of the light emitting element 7006 due to degradation, temperature and the like are corrected. When the driving transistor 7002 operates only in the linear region, whether a current is supplied to the light emitting element 7006 is often controlled digitally. In that case, a time gray scale method, an area gray scale method and the like are often used in combination for performing a multi-gray scale display.

EMBODIMENT MODE 6

Figure 6:
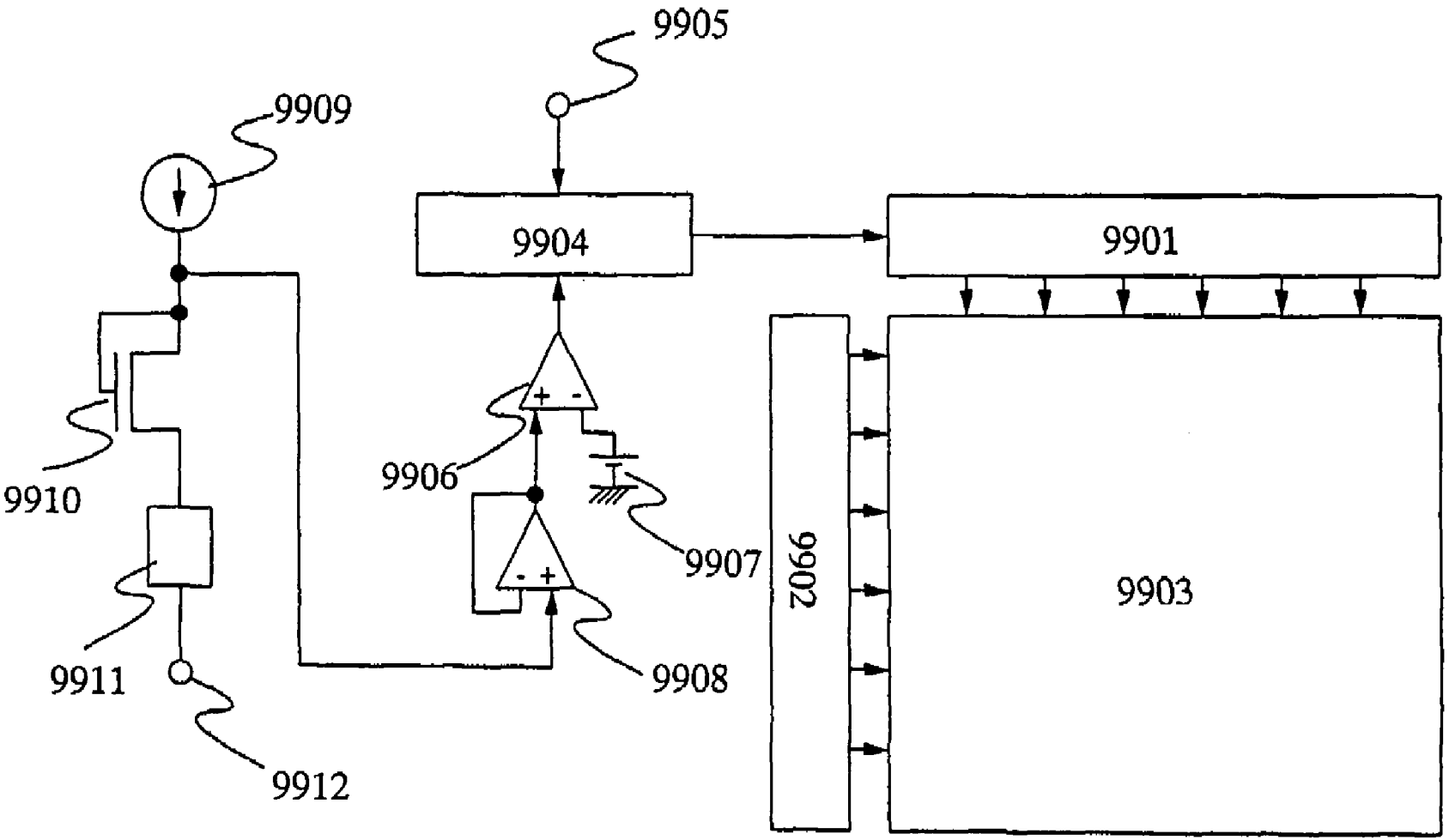
FIG. 6 is a diagram showing an example of correcting a video signal inputted to a signal driver circuit which drives a pixel portion.

FIG. 6 shows an example of correcting a video signal inputted to a signal driver circuit which drives a pixel portion. The example shown in FIG. 6 includes a source signal driver circuit 9901, a gate signal driver circuit 9902, a pixel portion 9903, an adder circuit 9904, a video input terminal 9905, a differential amplifier 9906, a reference power source 9907, a buffer amplifier 9908, a current source 9909, a monitoring TFT 9910, a monitoring light emitting element 9911, and an electrode 9912.

Hereinafter described is an operation thereof. A current is supplied from the current source 9909 to the monitoring TFT 9910 and the monitoring light emitting element 9911. Accordingly, a voltage according to the current is generated in the monitoring light emitting element 9911 and the monitoring TFT 9910. The voltage is inputted to a first input terminal of the differential amplifier 9906 through the buffer amplifier 9908 while a voltage of the reference power source 9907 is inputted to a second input terminal thereof. A different voltage between an output voltage of the buffer amplifier 9908 and an output voltage of the reference power source 9907 is inputted to the adder circuit 9904 after being amplified by the differential amplifier 9906. An output voltage of the differential amplifier 9906 and a video signal inputted from the video signal input terminal 9905 are added in the adder circuit 9904 and then inputted to the source signal driver circuit 9901. According to the video signal after the addition, the source signal driver circuit 9901 and the gate signal driver circuit 9902 can write a video signal into the pixel portion 9903.

In the initial stage, an output voltage of the buffer amplifier 9908 and an output voltage of the reference power source 9907 are set almost equal to each other. Accordingly, in the initial stage, a video signal inputted from the video signal input terminal 9905 is written to the pixel portion 9903 as it is. When the monitoring TFT 9910 and the monitoring light emitting element 9911 degrade with time, the voltages thereof change. When the voltage is inputted to the differential amplifier 9907 through the buffer amplifier 9908, a different voltage between the output voltages of the buffer amplifier 9908 and the reference power source 9907 is amplified by the differential amplifier 9906 and inputted to the adder circuit 9904. In the adder circuit 9904, the output voltage of the differential amplifier 9906 and a video signal are added, thereby an output voltage of the adder circuit 9904 becomes to a voltage after the correction of the degradation. By writing the output voltage of the adder circuit 9904 into the pixel portion 9903 by the source signal driver circuit 9901, data to be displayed is corrected. In this manner, degradation of TFT and light emitting element can be corrected.

Figure 7:
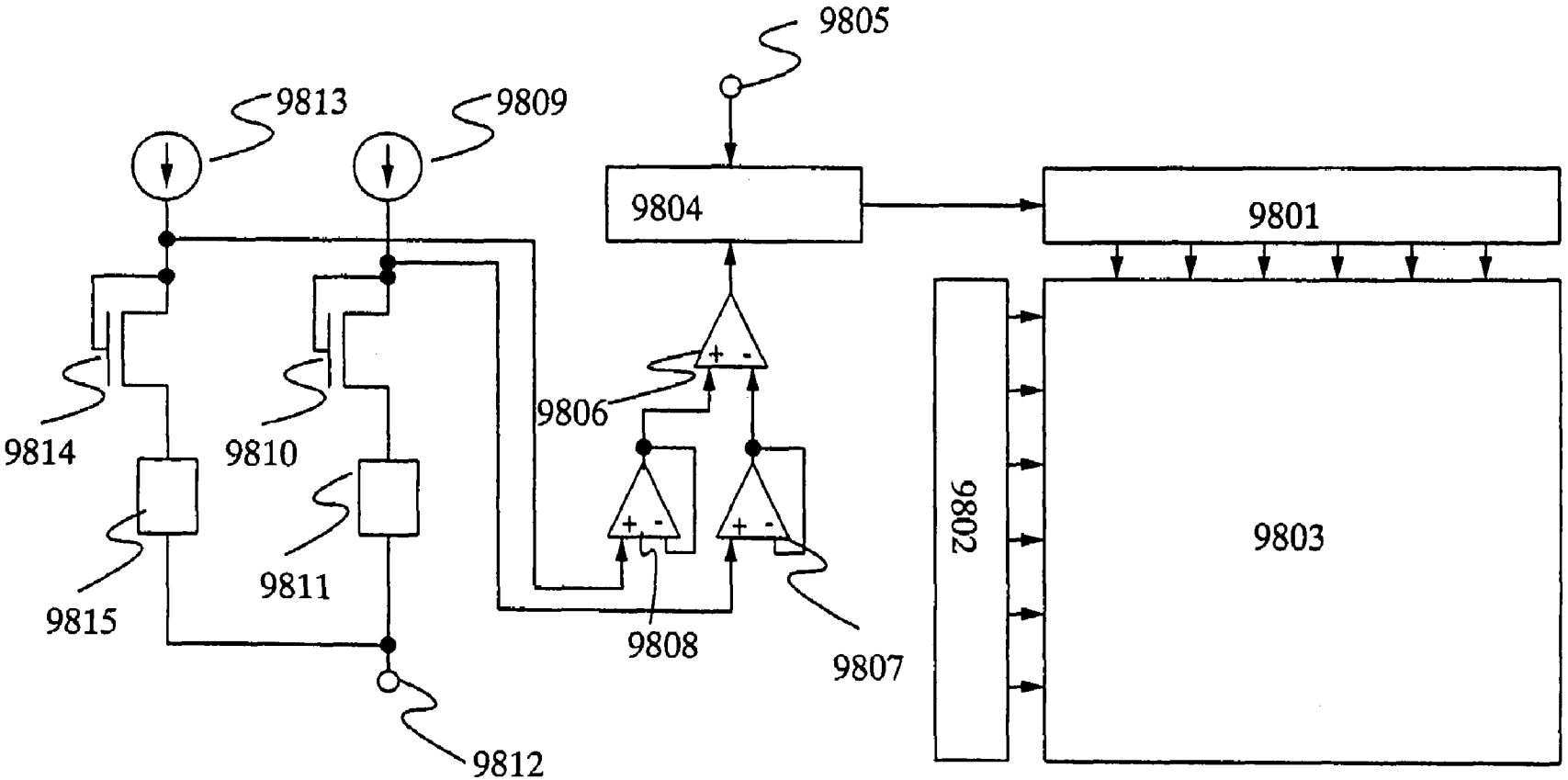
FIG. 7 is a diagram showing an example of correcting a video signal inputted to a signal driver circuit which drives a pixel portion.

FIG. 7 shows an example of correcting a video signal inputted to a signal driver circuit which drives a pixel portion. The example shown in FIG. 7 includes a source signal driver circuit 9801, a gate signal driver circuit 9802, a pixel portion 9803, an adder circuit 9804, a video input terminal 9805, a differential amplifier 9806, buffer amplifiers 9807 and 9808, current sources 9809 and 9813, monitoring TFTs 9810 and 9814, monitoring light emitting elements 9811 and 9815, and an electrode 9812.

Hereinafter described is an operation thereof. A current is supplied from the current source 9809 to the monitoring TFT 9810 and the monitoring light emitting element 9811. Accordingly, a voltage according to the current is generated in the monitoring light emitting element 9811 and the monitoring TFT 9810. The voltage is inputted to a first input terminal of the differential amplifier 9806 through the buffer amplifier 9808. A current is supplied from the current source 9813 to the monitoring TFT 9814 and the light emitting element 9815. Accordingly, a voltage according to the current is generated in the monitoring TFT 9814 and the monitoring light emitting element 9815. The voltage is inputted to a second input terminal of the differential amplifier 9806 through the buffer amplifier 9807. At this time, a current of the current source 9809 is set larger than that of the current source 9813. Because of the difference of current, a voltage of the first input terminal of the differential amplifier 9806 is different than that of the second input terminal thereof. This potential difference is compensated in the differential amplifier 9806 to make the voltage of the first and second terminals of the differential amplifier 9806 equal to each other.

An output voltage of the differential amplifier 9806 is inputted to the adder circuit 9804. In the adder circuit 9804, the output voltage of the differential amplifier 9806 and a video signal inputted from the video signal input terminal 9805 are added and inputted to the source signal driver circuit. According to the video signal after the addition, the source signal driver circuit and the gate signal driver circuit can write a video signal into the pixel portion 9803.

In the initial stage, an output voltage of the buffer amplifier 9808 and an output voltage of the buffer amplifier 9807 are different, however, the differential amplifier 9808 outputs a signal of zero because of the compensation by the differential amplifier 9806 as mentioned above. Accordingly, a video signal inputted from the video signal input terminal 9805 is written to the pixel portion 9803 as it is.

When the monitoring TFTs 9810 and 9814, and the monitoring light emitting elements 9811 and 9815 degrade with time, the voltages thereof change. The monitoring TFT 9810 and the monitoring light emitting element 9811 to which more current degrade is supplied more while the monitoring TFT 9814 and the monitoring light emitting element 9815 to which less current is supplied degrade less. Accordingly, although an output voltage of the buffer amplifier 9808 does not change much from the initial stage, an output voltage of the buffer amplifier 9807 considerably changes. The differential amplifier 9806 can output a voltage for the degradation of the monitoring TFT 9810 and the monitoring light emitting element 9811 according to a difference therebetween. The voltage for degradation is amplified by the differential amplifier 9806 and inputted to the adder circuit 9804. In the adder circuit 9804, an output voltage of the differential amplifier 9806 and the video signal are added, thereby an output voltage of the adder circuit 9804 corresponds to the one after the correction of degradation. By writing the output voltage of the adder circuit 9804 into the pixel portion 9803 by the source signal driver circuit, data for display is corrected. In this manner, degradation of the TFTs and the light emitting element can be corrected.

EMBODIMENT MODE 7

In this embodiment mode, an example of manufacture of an active matrix display device having a channel etch type TFT as a switching element is described with reference to the drawings.

Figures 8A, 8B, 8C, 8D, 8E:
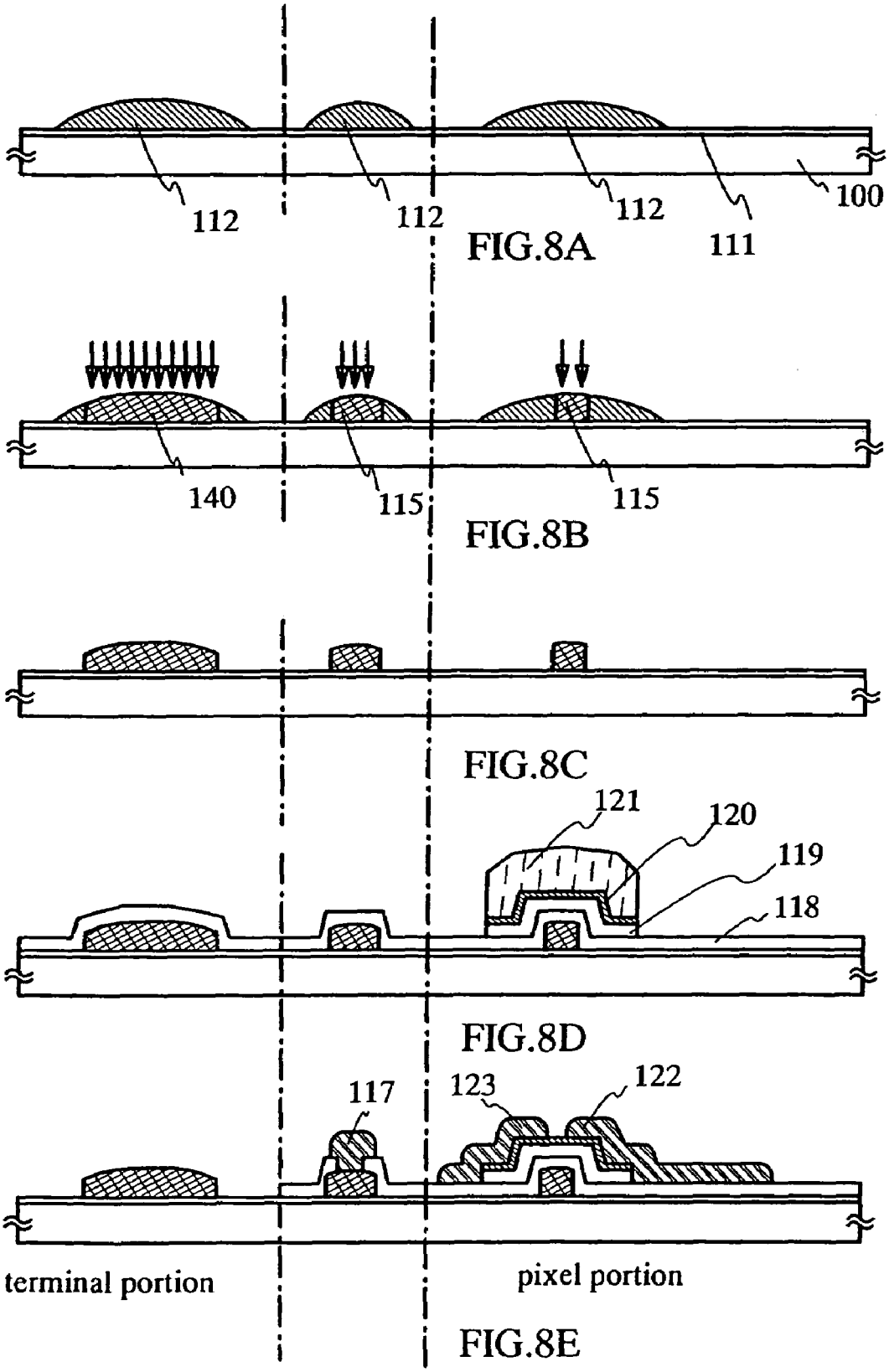
FIGS. 8A to 8E are sectional diagrams showing manufacturing steps of an EL display panel according to one embodiment mode.

As shown in FIG. 8A, a base layer 111 is formed for improving adhesion of a substrate 110 and a material layer which is formed later thereover by droplet discharge method. The base layer 111 is formed quite thin, therefore, it does not necessarily have a stacked-layer structure. The base layer 111 is formed by forming over the entire surface a photocatalytic substance (titanium oxide ($TiO_x$), strontium titanate ($SrTiO_3$), cadmium selenide (CdSe), potassium tantalate ($KTaO_3$), cadmium sulfide (CdS), zirconium oxide ($ZrO_2$), niobium oxide ($Nb_2O_5$), zinc oxide (ZnO), iron oxide ($Fe_2O_3$), tungsten oxide ($WO_3$)) by spraying or sputtering method. Alternatively, an organic material (an coating insulating film formed by using a material having a skeleton structure of polyimide, acrylic, or a Si—O bond having at least one of hydrogen, fluoride, alkyl group, or aromatic carbon hydride as a substituent) may be selectively formed by ink-jetting or sol-gel method. This can be regarded as a pretreatment of the base layer as well.

Here, an example of providing the pretreatment of the base layer for improving adhesion between a discharged conductive material and a substrate has been described. In the case of forming a material layer (for example, an organic layer, an inorganic layer, or a metal layer), or further a material layer (for example, an organic layer, an inorganic layer, or a metal layer) on the discharged conductive layer by droplet discharge method, a TiOx deposition treatment may be performed for improving adhesion between the material layers. That is to say, when drawing by discharging a conductive material by a droplet discharge method, it is preferable to provide a pretreatment of the base layer for the top and bottom interfaces of the conductive material layer for improving adhesion thereof.

The base layer 111 is not limited to be formed of a photocatalytic material but can be formed of a 3d transition metal (Sc, Ti, Cr, Ni, V, Mn, Fe, Co, Cu, Zn, and the like), or an oxide, a nitride, or an oxynitride thereof.

It is to be noted that a substrate 100 may be a non-alkaline glass substrate formed by a fusing method or a floating method, such as a barium borosilicate glass, an aluminoborosilicate glass, and an aluminosilicate glass as well as a plastic substrate and the like having a heat resistance against processing temperature of this manufacturing step.

Next, a conductive layer pattern 112 is formed by discharging a liquid conductive material by a droplet discharge method represented by an ink-jetting method (see FIG. 8A). As a conductive material contained in the liquid conductive material, gold (Au), silver (Ag), copper (Cu), platinum (Pt), palladium (Pd), tungsten (W), nickel (Ni), tantalum (Ta), bismuth (Bi), lead (Pb), indium (In), tin (Sn), zinc (Zn), titanium (Ti), or aluminum (Al), or an alloy thereof, dispersive nanoparticles of these, or micro particles of halogenated silver are used. In particular, it is preferable that a gate wiring have low resistance, therefore, gold, silver, or copper dissolved or dispersed in solvent is preferably used in consideration of specific resistance value. More preferably, low resistant silver or copper is used. In the case of using silver or copper, however, a barrier film is preferably provided in combination for preventing impurities from dispersing. For the solvent, esters such as butyl acetate, alcohols such as isopropyl alcohol, organic solvent such as acetone and the like are used. The surface tension and viscosity are arbitrarily controlled by controlling the concentration of solvent, adding surfactant, or the like.

Figure 15:
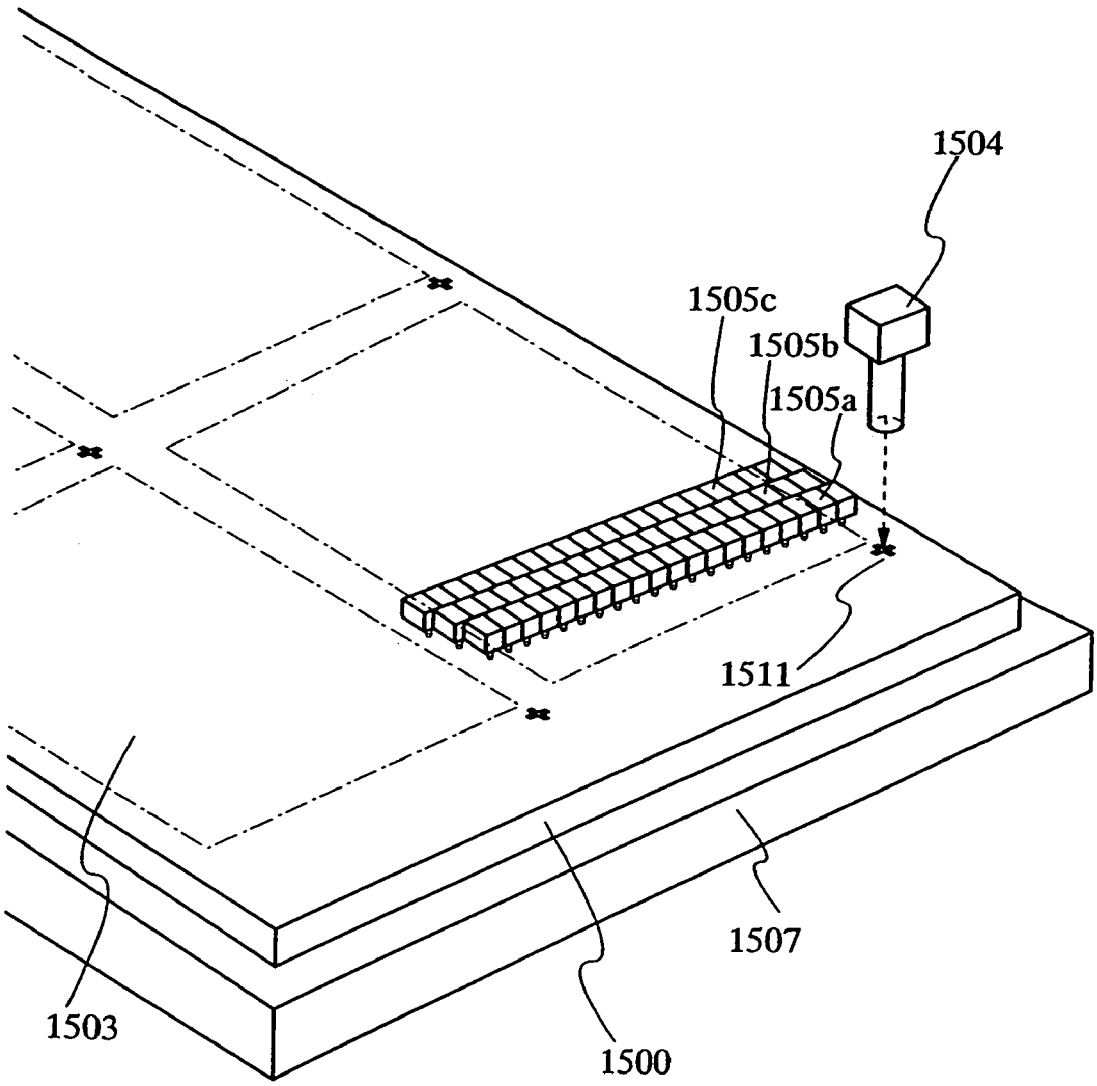
FIG. 15 is a perspective view of a droplet discharge apparatus.

FIG. 15 shows an example of a droplet discharge apparatus. In FIG. 15, reference numeral 1500 denotes a large substrate, 1504 denotes an image pick-up means, 1507 denotes a stage, 1511 denotes a marker, 1503 denotes a region for one panel. Heads 1505*a*, 1505*b*, and 1505*c* each of which has the same width as the width of one panel are provided, which scan in zigzag or back and forth to form a pattern of a material layer appropriately while moving the stage. A head having the same width as that of the large substrate can be used as well, however, the head of a panel size as shown in FIG. 15 is easy to operate. In order to improve throughput, it is preferable to discharge a material while the stage is moving.

Moreover, it is preferable that the heads 1505*a*, 1505*b*, and 1505*c* and the stage 1507 each have a temperature control function. Note that the distance between the head (tip of a nozzle) and the large substrate is about 1 mm. The shorter this distance is, the higher the discharge accuracy is.

In FIG. 15, each of the heads 1505*a*, 1505*b*, and 1505*c* arranged in three columns to a scan direction may be capable of forming different material layers respectively, or may discharge the same material. By patterning an interlayer insulating film 128 by discharging the same material using the three heads, throughput is improved. When scanning by the apparatus shown in FIG. 15, a substrate 1500 can be moved with a head portion fixed or the head portion can be moved with the substrate 1500 fixed.

Each of the heads 1505*a*, 1505*b*, and 1505*c* of the droplet discharge apparatus is connected to a control means which enables to draw a programmed pattern in advance by using a computer. The amount of discharge is controlled by a pulse voltage to be applied. The timing to draw is, for example, based on the marker formed on the substrate. Alternatively, a reference point may be determined based on the frame of the substrate. This is detected by an image pick-up means such as a CCD, then a digital signal converted by an image processing means is processed by a computer to generate a control signal to be transmitted to the control means. It is needless to say that data on pattern to be formed over the substrate is stored in a memory medium. Based on this data, a control signal is transmitted to the control means to control each of the heads of the droplet discharge apparatus independently.

Next, a portion of the conductive film pattern is exposed by selective laser light irradiation (see FIG. 8B). A photosensitive material is contained in advance in the liquid conductive film material to be discharged so that it chemically reacts with the laser light. The photosensitive material here is a negative type that a portion which chemically reacts with the laser light remains. By laser irradiation, an accurate pattern can be formed, in particular a wiring of thin width can be obtained.

Figure 13:
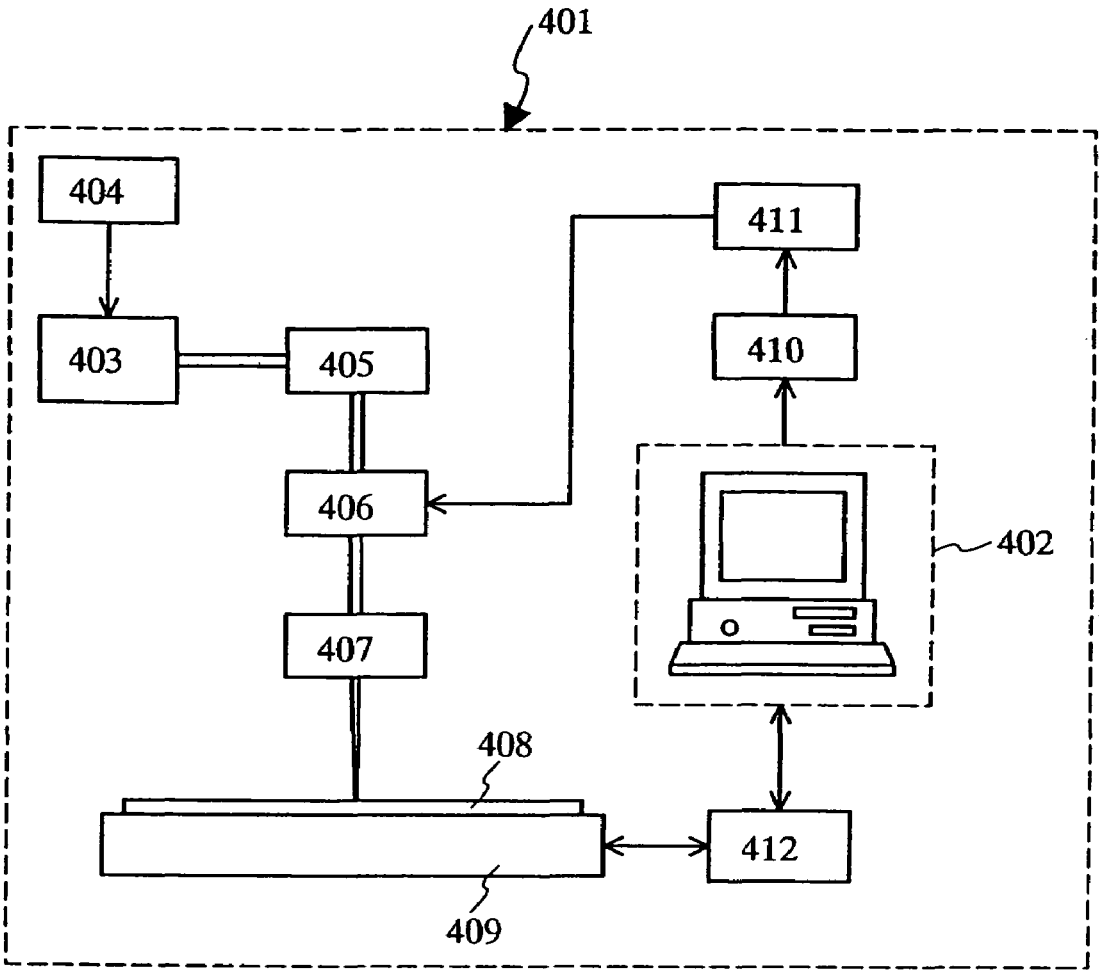
FIG. 13 is a diagram showing a structure of a laser beam drawing apparatus.

Here, description is made on a laser beam drawing apparatus with reference to FIG. 13. A laser beam drawing apparatus 401 includes a personal computer (hereinafter also referred to as a PC) 402 which executes various controls in laser beam irradiation, a laser oscillator 403 which outputs a laser beam, a power source 404 of the laser oscillator 403, an optical system (ND filter) 405 for attenuating a laser beam, an acoustic-optic modulator (AOM) 406 for modulating the intensity of a laser beam, a lens for enlarging or narrowing the laser beam cross-section, an optical system 407 formed by a mirror and the like for changing light path, a substrate moving assembly 409 having an X stage and a Y stage, a D/A converter 410 for converting control data outputted from the PC between digital and analog, a driver 411 for controlling the acoustic-optic modulator 406 in accordance with an analog voltage outputted from the D/A converter 410, and a driver 412 for outputting a driving signal for driving the substrate moving assembly 409.

For the laser oscillator 403, a laser oscillator capable of oscillating ultraviolet light, visible light, or infrared light can be used. As such a laser oscillator, an excimer laser oscillator such as KrF, ArF, XeCl, and Xe, a gas laser oscillator such as He, He—Cd, Ar, He—Ne, and HF, a solid state laser oscillator using a crystal obtained by doping Cr, Nd, Er, Ho, Ce, Co, Ti, or Tm to YAG $GdVO_4$, $YVO_4$, YLF, and $YAlO_3$, a semiconductor laser oscillator such as GaN, GaAs, GaAlAs, and InGaAsP can be used. It is to be noted that first to fifth harmonic waves of the fundamental wave are preferably used for the solid state laser oscillator.

Hereinafter described is an exposing method of a photosensitive material using a laser beam direct drawing apparatus. It is to be noted that the photosensitive material here is a conductive film material (including a photosensitive material) to be a conductive film pattern After a substrate 408 is mounted on the substrate moving assembly 409, the PC 402 detects the position of the marker on the substrate by a camera which is not shown in the drawing. Then, the PC 402 generates moving data for moving the substrate moving assembly 409 based on the detected position data of the marker and drawing pattern data which is inputted in advance. After that, the PC 402 controls the amount of output light from the acoustic-optic modulator 406 through the driver 411, thereby laser beam outputted from the laser oscillator 403 is attenuated by the optical system 405 and controlled so as to be a predetermined amount by the acoustic-optic modulator 406. On the other hand, the laser beam outputted from the acoustic-optic modulator 406 are changed in light path and beam shape by the optical system 407 and condensed by the lens. Then, the photosensitive material formed over the substrate is irradiated with the laser beam to be exposed. At this time, the substrate moving assembly 409 is controlled to move in X and Y directions based on the moving data generated by the PC 402. As a result, a predetermined place is irradiated with laser beam, thereby the photosensitive material is exposed.

It is to be noted that a portion of the energy of laser light irradiated to the photosensitive material is converted into heat, which makes a portion of the photosensitive material react. Therefore, a pattern width becomes slightly wider than that of the laser beam. It is preferable to use laser beam of shorter wavelength to form a pattern of fine width since a beam diameter can be condensed to be small.

A spot shape of the laser beam on the surface of the photosensitive material is processed by the optical system to be a dot shape, a circular shape, an oval shape, a rectangular shape, or a linear shape (specifically shape of an elongated rectangle). It is to be noted that the spot shape may be a circular shape, however, a linear shape is more preferable to obtain a pattern of even width.

According to the apparatus shown in FIG. 13, the surface of the substrate is exposed by laser light irradiation, however, the back side of the substrate may be exposed by the laser light by appropriately changing the optical system and the substrate moving assembly. It is to be noted that the laser beam is selectively irradiated by moving the substrate, however, the invention is not limited to this. The laser beam can be scanned in X-Y directions to be irradiated. In this case, it is preferable to use a polygon mirror or a galvanometer mirror for the optical system 407.

Next, development is performed by using etchant (or developer) to remove unnecessary portions, then main baking is performed to form a metal wiring 115 to be a gate electrode or a gate wiring (see FIG. 8C).

A wiring 140 which extends to a terminal is formed similarly to the metal wiring 115. Although not shown here, a power source line for supplying a current to a light emitting element may be formed as well. Moreover, a capacitor electrode or a capacitor wiring for forming a capacitor is formed as required. When using a positive type photosensitive material, laser irradiation is performed to a portion to be removed to achieve chemical reaction therein. Then, that portion is dissolved by etchant. Moreover, laser light may be irradiated after performing room temperature drying or selective baking after discharging liquid conductive film material.

Next, a gate insulating film 118, a semiconductor film, and an N-type semiconductor film are sequentially deposited by a plasma CVD method or a sputtering method. For the gate insulating film 118, a material containing silicon oxide, silicon nitride, or silicon nitride oxide as a main component, which is obtained by a PCVD method is used. Moreover, a $SiO_x$ film containing an alkyl group may be used for the gate insulating film 118 after discharging by a droplet discharge method using siloxane-based polymer and baking.

A semiconductor film is formed of an amorphous semiconductor film or a semi-amorphous film formed by a vapor phase epitaxy method, a sputtering method, a thermal CVD method using a semiconductor material gas represented by silane and germane, or a semi-amorphous semiconductor film. For amorphous semiconductor film, an amorphous silicon film formed by the PCVD method using $SiH_4$ or a mixed gas of $SiH_4$ and $H_2$ can be used. Moreover, for the semi-amorphous (also referred to as microcrystal) semiconductor film, a semi-amorphous silicon film obtained by the PCVD method using a mixed gas obtained by diluting $SiH_4$ with 3 to 1000 times of $H_2$, a mixed gas obtained by diluting $Si_2H_6$ with $GeF_4$ at a gas flow rate of 20 to 40:0.9 ($Si_2H_6$: $G_3F_4$), a mixed gas of $Si_2H_6$ and $F_2$, or a mixed gas of $SiH_4$ and $F_2$. Note that the semi-amorphous silicon film is favorably used since more crystallinity can be given to the interface with the base layer.

Further, the crystallinity may be improved by irradiating the semi-amorphous silicon film obtained by a PCVD method using a mixed gas of $SiH_4$ and $F_2$ with laser light.

The N-type semiconductor film may be an amorphous semiconductor film or a semi-amorphous semiconductor film formed by a PCVD method using a silane gas and phosphine gas. When an N-type semiconductor film 120 is provided, it is preferable that contact resistance between the semiconductor film and an electrode (electrode formed later) is required to be low.

Next, a mask 121 is provided and the semiconductor film and the N-type semiconductor film are selectively etched to obtain an island shape semiconductor film 119 and an N-type semiconductor film 120 (see FIG. 8D). The mask 121 is formed by a droplet discharge method and a printing method (relief printing plate, flat plate, copperplate printing, screen and the like). A desired mask pattern may be formed directly by a droplet discharge method or a printing method, however, a rough resist pattern may be formed by a droplet discharge method and a printing method and then selectively exposed by laser light to obtain a fine resist pattern with accuracy.

By using the laser beam drawing apparatus shown in FIG. 13, exposure of resist can be performed. In that case, the resist mask 121 is to be formed by exposing by laser light with a photosensitive material as a resist.

Next, after removing the mask 121, a mask (not shown) is provided to etch a gate insulating film selectively, thereby a contact hole is formed. The gate insulating film is removed in the terminal. The mask may be formed by a typical photolithography technique, by forming a resist pattern by droplet discharge method, or by forming a resist pattern by applying a positive resist over the entire surface and performing exposure with laser light and development. In an active matrix light emitting device, a plurality of TFTs are formed in one pixel, which are connected to a wiring of the upper layer through the gate electrode and the gate insulating film.

Next, a composition containing a conductive material (Ag (silver), Au (gold), Cu (copper), W (tungsten), Al (aluminum) and the like) is selectively discharged by droplet discharge method to form source or drain (referred to as source/drain) wirings 122 and 123, or a leading electrode 117. Similarly, a power source line for supplying a current to the light emitting element and a connecting wiring (not shown) at the terminal are formed (see FIG. 8E).

Figure 9A:
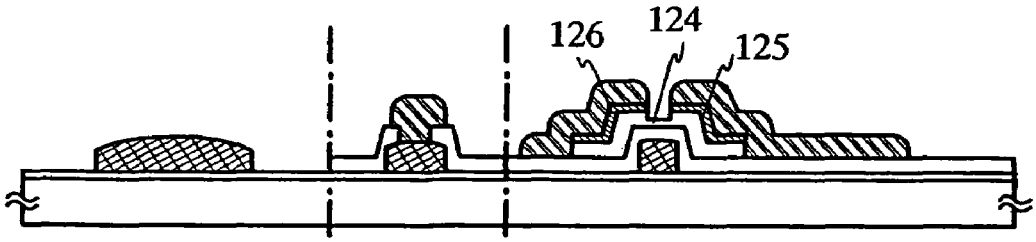
FIGS. 9A to 9D are sectional diagrams showing manufacturing steps of an EL display panel according to one embodiment mode.

Next, the N-type semiconductor film and a top layer of the semiconductor film are etched using the source/drain wirings 122 and 123 as masks to obtain a state of FIG. 9A. At this stage, a channel etch type TFT provided with a channel forming region 124 to be an active layer, a source region 126, and a drain region 125 is completed.

Figure 9B:
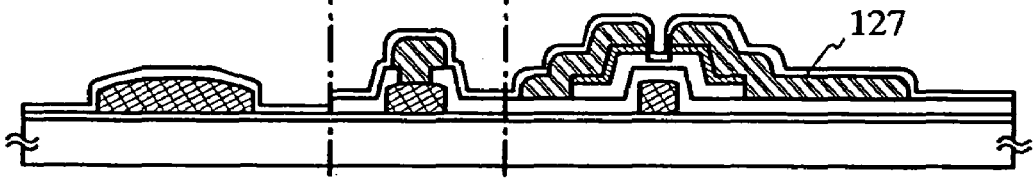

Next, a protective film 127 is formed for protecting the channel forming region 124 from being contaminated by impurities (see FIG. 9B). For the protective film 127, a material mainly containing silicon nitride or silicon nitride oxide obtained by sputtering method or, PCVD method is used. Here, the protective film 127 is formed as an example, however, it is not necessarily formed.

Next, an interlayer insulating film 128 is selectively formed by droplet discharge method. The interlayer insulating film 128 is formed of a resin material such as an epoxy resin, an acrylic resin, a phenol resin, a novolac resin, a melamine resin, and an urethane resin is used. In addition, the interlayer insulating film 128 is formed by a droplet discharge method using an organic material such as benzocyclobutene, parylene, flare, or light-transmissive polyimide; a compound material made from polymerization of such as siloxane polymer; a composition material containing water-soluble homopolymer and water-soluble copolymer; or the like. The interlayer insulating film 128 is not limited to be formed by a droplet discharge method, and it can be formed over the entire surface by a coating method, a PCVD method and the like.

Next, the protective film 127 is etched using the interlayer insulating film 128 as a mask to form a projecting portion (pillar) 129 formed of a conductive material over portions of the source/drain wirings 122 and 123. The projecting portion (pillar) 129 may be formed by a stacked-layer by repeating discharging and baking a composition containing a conductive material (Ag (silver), Au (gold), Cu (copper), W (tungsten), Al (aluminum) and the like).

Figure 9C:
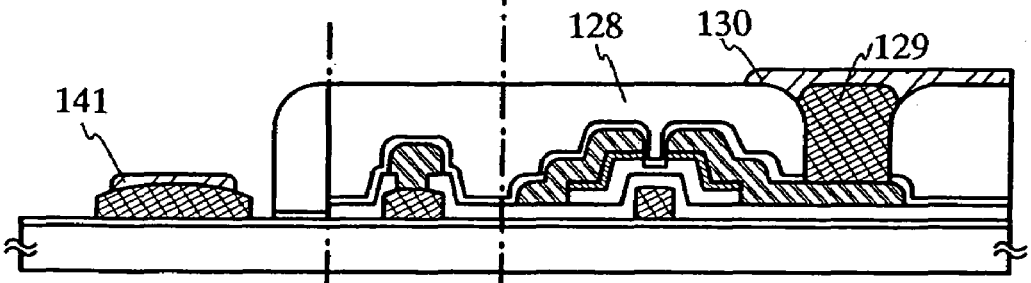

A first electrode 130 in contact with the projecting portion (pillar) 129 is formed over the interlayer insulating film 128 (see FIG. 9C). It is to be noted that a terminal electrode 141 in contact with a wiring 140 is formed similarly. Here, it is an example that a driving TFT is an N-channel TFT, therefore, it is preferable that the first electrode 130 function as a cathode. In the case of a light-transmissive type, the first electrode 130 is formed by a droplet discharge method or a printing method using a predetermined pattern is formed of a composition containing indium tin oxide (ITO), indium tin oxide containing silicon oxide (ITSO), zinc oxide (ZnO), tin oxide ($SnO_2$) and the like, and then baked to form the first electrode 130 and the terminal electrode 141. Moreover, in the case of reflecting light on the first electrode 130, a predetermined pattern is formed by a droplet discharge method using a composition containing mainly metal particles such as Ag (silver), Au (gold), Cu (copper), W (tungsten), and Al (aluminum), and then baked to form the electrode 130 and the terminal electrode 141. Alternatively, the first electrode 130 may be formed by forming a light-transmissive conductive film or a light-reflective conductive film by a sputtering method, forming a mask pattern by droplet discharge method, and performing etching in combination.

Figure 9D:
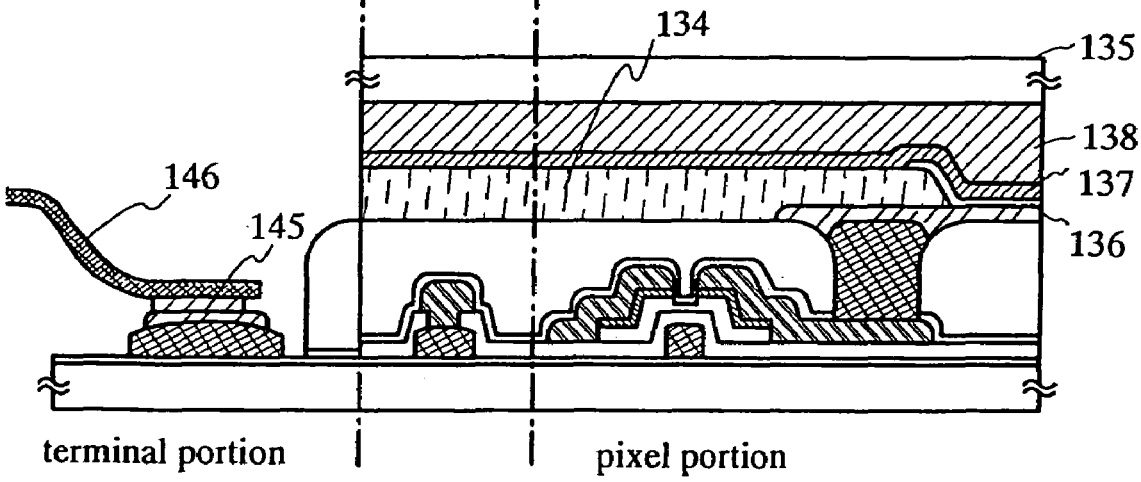
Figure 10:
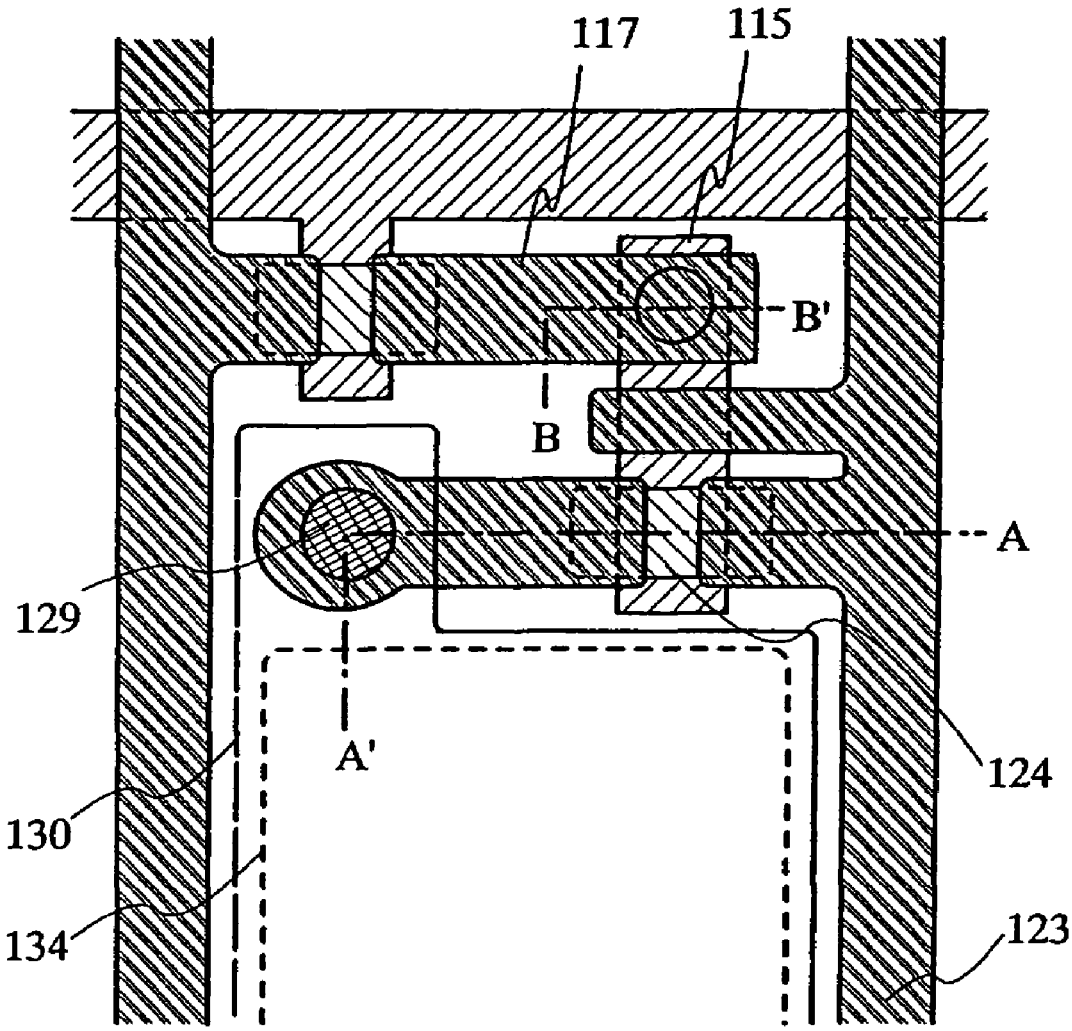
FIG. 10 is a top view of an EL display panel according to one embodiment mode.

FIG. 10 is an example of a top view of the pixel of the FIG. 9C. A sectional view of the right side of the pixel portion of FIG. 9C corresponds to a sectional view taken along a chain line A-A' in FIG. 10, while the left side thereof corresponds to a sectional view taken along a chain line B-B'. In FIG. 10, the same reference numerals are used for the identical portions to FIGS. 8A to 9D. In FIG. 10, an edge of a partition wall 134 formed later is shown by a dotted line.

Although the interlayer insulating film 128 and the projecting portion (pillar) 129 are formed separately as the protective film 127 is provided here, they can be formed by the same apparatus by droplet discharge method when the protective film 127 is not provided.

Next, a partition wall 134 for covering a peripheral portion of the first electrode 130 is formed. The partition wall (also referred to as a bank) 134 is formed of a material containing silicon, an organic material, and a compound material. Moreover, a porous film may be used as well. By using a photosensitive or non-photosensitive material such as acrylic and polyimide, it is preferable that a side thereof has a curvature radius which continuously changes, thus an upper thin film can be formed without breaking.

In above-mentioned manner, a TFT substrate for a light emitting display panel in which a bottom gate (also referred to as an inverted staggered type) TFT and the first electrode 130 are formed over the substrate 100 is completed.

Next, a layer which functions as an electroluminescent layer (also referred to as an EL layer), that is a layer 136 containing an organic compound is formed. The layer 136 containing an organic compound has a stacked-layer structure each of which is formed by a vapor deposition method or a coating method. For example, an electron transporting layer (electron injection layer), a light emitting layer, a hole transporting layer, and a hole injection layer are sequentially stacked on a cathode.

The electron transporting layer contains a charge injecting-transporting substance. As a charge injecting-transporting material having a high electron transporting property, a metal complex or the like having a quinoline skeleton or a benzoquinoline skeleton such as tris(8-quinolinolate) aluminum ($Alq_3$), tris(5-methyl-8-quinolinolate) aluminum ($Almq_3$), bis(10-hydroxybenzo[h]-quinolinato) beryllium ($BeBq_2$), and bis(2-methyl-8-quinolinolate)-4-phenylphenolato-aluminum (BAlq) can be nominated. As a material having a high hole transporting property, an aromatic amine-based compound (that is, the one having a benzene ring-nitrogen bond) such as 4,4'-bis[N-(1-naphthyl)-N-phenyl-amino]-biphenyl (a-NPD), 4,4'-bis[N-(3-methylphenyl)-N-phenyl-amino]-biphenyl (TPD), 4,4',4"-tris(N,N-diphenyl-amino)-triphenyl amine (TDATA), and 4,4',4"-tris[N-(3-methylphenyl)-N-phenyl-amino]-triphenyl amine (MTDATA) can be used.

Among the charge injecting-transporting material, as a material especially having a high electron injection property, a compound of an alkali metal or an alkali earth metal such as lithium fluoride (LiF), cesium fluoride (CsF), and calcium fluoride ($CaF_2$) can be used. Besides, mixture of a material having a high electron transportation property such as $Alq_3$ and an alkali earth metal such as magnesium (Mg) can be used.

A light-emitting layer is formed by a charge injecting-transporting material and a light-emitting material, each of which contains an organic compound or an inorganic compound. The light emitting layer may include a layer formed of one or a plurality of layers selected based on its number of molecules from a low molecular weight organic compound, an intermediate molecular weight organic compound (which can be defined as an organic compound which does not have subliming property, and has the number of molecules of 20 or less, or a molecular chain length of 10 μm or less), and a high molecular weight (also referred to as a polymer) organic compound. An inorganic compound having an electron injecting-transporting property or a hole injecting-transporting property may be used in combination As a material for the light-emitting layer, various materials can be used. As a low molecular weight organic light emitting material, 4-dicyanomethylene-2-methyl-6-[2-(1,1,7,7-tetramethyl-julolidylyl-9)ethenyl]-4H-pyran (DCJT), 4-dicyanomethylene-2-t-butyl-6-[2-(1,1,7,7-tetramethyl julolidine-9-yl)ethenyl]-4H-pyran (DCJTB), periflanthene, 2,5-dicyano-1,4-bis[2-(10-methoxy-1,1,7,7-tetramethyl julolidine-9-yl)ethenyl]benzene, N,N'-dimethyl quinacridon (DMQd), coumarin 6, coumarin 545T, tris(8-quinolinolate) aluminum ($Alq_3$), 9,9-bianthryl, 9,10-diphenylanthracene (DPA), 9,10-bis(2-naphthyl)anthracene (DNA), or the like can be used. Other materials may be used as well.

A high molecular weight organic light emitting material is physically stronger than a low molecular weight organic light emitting material. A light emitting element formed by the high molecular weight organic light emitting material is superior in durability. A light emitting element using the high molecular weight organic light emitting material can be manufactured rather easily since a light emitting layer can be formed by coating. The structure of the light emitting element using the high molecular weight organic light emitting material is basically the same as that using the low molecular weight organic light emitting material, that is, a cathode, an organic light emitting layer, and an anode are stacked sequentially. However, in the case where the light emitting layer is formed of the high molecular weight organic light emitting material, it is difficult to form a stacked-layer structure like the case of using the low molecular weight organic light emitting material. Therefore, the light emitting element using the high molecular Weight organic light emitting material is formed to have a two-layer structure in many cases. Specifically, a cathode, a light emitting layer, a hole transporting layer, and an anode are stacked sequentially.

Emission color is determined by a material of the light emitting layer. Accordingly, a light emitting element which exhibits desired emission color can be formed by selecting the material for the light emitting layer. As a high molecular weight-based electroluminescent material for forming the light emitting layer, a polyparaphenylene vinylene-based material, a polyparaphenylene-based material, a polythiophene-based material, a polyfluorene-based material can be used.

As the polyparaphenylene vinylene-based material, a derivative of poly(paraphenylene vinylene) (PPV), poly(2,5-dialkoxy-1,4-phenylenevinylene) (RO-PPV), poly(2-(2'-ethyl-hexoxy)-5-methoxy-1,4-phenylene vinylene) (MEH-PPV), poly(2-dialkoxyphenyl)-1,4-phenylenevinylene) (ROPh-PPV), and the like can be used. As the polyparaphenylene-based material, a derivative of polyparaphenylene (PPP), poly(2,5-dialkoxy-1,4-phenylene) (RO-PPP), poly(2,5-dihexoxy-1,4-phenylene), and the like can be used. As the polythiophene-based material, a derivative of polythiophene (PT), poly(3-alkylthiophene) (PAT), poly(3-hexylthiophene) (PHT), poly(3-cyclohexylthiophene) (PCHT), poly(3-cyclohexyl-4-methylthiophene) (PCHMT), poly(3,4-dicyclohexylthiophene) (PDCHT), poly[3-(4-octylphenyl)-thiophene] (POPT), poly[3-(4-octylphenyl)-2,2-bithiophene] (PTOPT), and the like can be used. As the polyfluorene-based material, a derivative of polyfluorene (PF), poly(9,9-dialkylfluorene) (PDAF), poly(9,9-dioctylfluorene) (PDOF), and the like can be used.

A hole injection property from the anode can be improved by interposing a high molecular weight-based organic light emitting material having a hole transporting property between the anode and a high molecular weight organic light emitting material having a light emitting property. Generally, the high molecular weight-based organic light emitting material having a hole transporting property and an acceptor material dissolved in water together are coated by spin coating. The high molecular weight-based organic light emitting material having a hole transporting property is insoluble in organic solvent, thus, the organic light emitting material having a light emitting property can be stacked over the material. As the high molecular weight-based organic light emitting material having a hole transporting property, mixture of PEDOT and camphoric sulfonic acid (CSA) as an acceptor material, mixture of polyaniline (PANI) and polystyrene sulfonic acid (PSS) as an acceptor material, and the like can be used.

Besides a singlet excited light emitting material, a triplet excited material containing a metal complex or the like can be used for the light emitting layer. For example, among a red light emitting pixel, a green light emitting pixel, and a blue light emitting pixel; a red light emitting pixel whose luminance is reduced by half luminance in a relatively short time is formed by a triplet excited light emitting material and the others are formed by singlet excited light emitting materials. The triplet excited light emitting material has a characteristic that it consumes less power than the singlet excited light emitting material to obtain a certain luminance since the triplet excited light emitting material has high luminous efficiency. In the case where the triplet excited light emitting material is used for forming the red light emitting pixel, the reliability can be improved since the light emitting element requires a small amount of current. To reduce power consumption, the red light emitting pixel and the green light emitting pixel may be formed by the triplet excited light emitting material, and the blue light emitting pixel may be formed by a singlet excited light emitting material. The power consumption of a green light emitting element which is highly visible to human eyes can be reduced by using the triplet excited light emitting material.

As an example for the triplet excited light emitting material, a material using a metal complex as a dopant including platinum which is the third transition element as a central metal or a metal complex including iridium as a central metal is well known. The triplet excited light emitting material is not limited to these compounds. A compound that has the aforementioned structure and has an element belonging to groups 8 to 10 of the periodic table as a central metal can be used.

The hole transporting layer contains a charge injecting-transporting substance. As a material having a high hole injection property, for example, metal oxide such as molybdenum oxide (MoOx), vanadium oxide (VOx), ruthenium oxide (RuOx), tungsten oxide (WOx), and manganese oxide (MnOx), can be nominated. Besides, a phthalocyanine-based compound such as phthalocyanine ($H_2Pc$) or copper phthalocyanine (CuPc) can be used.

Before forming the layer 136 containing an organic compound, plasma treatment in the oxygen atmosphere or heat treatment in vacuum atmosphere is preferably performed. In the case of employing vapor deposition, an organic compound is vaporized by resistance heating in advance and scattered toward a substrate by opening a shutter in depositing the organic compound. The vaporized organic compound is scattered upward and deposited over the substrate through an opening portion provided in a metal mask. To realize a full color display, a mask may be aligned per emission color (R, G, and B).

A light emitting layer may have the structure in which light emitting layers having different emission wavelength bands respectively are provided to each pixel for realizing a full color display. Typically, light emitting layers corresponding to the colors of R (red), G (green), and B (blue) are formed. In this case, color purity can be improved and a pixel portion can be prevented from being a mirror surface (glare) by providing a filter (colored layer) which transmits light of each emission wavelength band to the light emission side of the pixel. By providing the filter (colored layer), a circular polarizer or the like which is conventionally required is not required any longer. Further, light can be emitted from the light emitting layer without any loss. Moreover, change of tone occurring when the pixel portion (display screen) is seen obliquely can further be reduced.

Alternatively, a full color display can be realized by using a material exhibiting a monochromatic emission as the layer 136 containing an organic compound, and combining a color filter or a color conversion layer without separate deposition. For example, in the case where an electroluminescent layer exhibiting white or orange emission is formed, a full color display can be realized by separately providing a color filter, a color conversion layer, or a combination of the color filter and the color conversion layer on the light emission side of the pixel. The color filter or the color conversion layer may be formed, for example, over a second substrate (sealing substrate) and attached to the substrate 100. Further, as described above, all of the material exhibiting monochromatic emission, the color filter, and the color conversion layer can be formed by droplet discharge method.

To form a light emitting layer which exhibits white emission, for example, $Alq_3$, $Alq_3$ partly doped with Nile red, $Alq_3$, p-EtTAZ, TPD (aromatic diamine) are deposited sequentially by vapor deposition. In the case where the EL layer is formed by spin coating, the coated layer is preferably baked by vacuum heating after being coated. For example, poly(ethylene dioxythiophene)/poly(styrene sulfonate) solution (PEDOT/PSS) which acts as the hole injecting layer may be coated over the whole surface and baked, and then polyvinylcarbazole (PVK) doped with emission center pigments (1,1,4,4-tetraphenyl-1,3-butadiene (TPB), 4-dicyanomethylene-2-methyl-6-(p-dimethylamino-styryl)-4H-pyran (DCM1), Nile red, coumarin 6, or the like) acts as the light emitting layer may be coated over the whole surface and baked.

The light emitting layer may be formed of a single layer as well. In this case, the light emitting layer may be formed of polyvinylcarbazole (PVK) with the hole transporting property dispersed with a 1,3,4-oxadiazole derivative (PBD) with the electron transporting property. Further, white emission can be obtained by dispersing PBD by 30 wt % as the electron transporting material and dispersing an appropriate amount of four kinds of pigments (TPB, coumarin 6, DCM1, and Nile red).

The aforementioned materials for forming the layer containing an organic compound are only examples. The light emitting element can be formed by accordingly stacking functional layers such as a hole injecting-transporting layer, a hole transporting layer, an electron injecting-transporting layer, an electron transporting layer, a light emitting layer, an electron blocking layer, and a hole blocking layer. A mixed layer or mixed junction of mixing the aforementioned layers may also be formed. The layer structure of the light emitting layer may vary. Instead of providing a specific electron injecting region or light emitting region, modifications of the structure such as providing an electrode in order to be used for the electron injecting region or the light emitting region, or providing a dispersed light emitting material can be allowed unless such modifications depart from the scope of the invention.

It is needless to say that a monochromatic light emission display can be performed. For example, an area color type light emitting display device can be formed by utilizing monochromatic light emission. A passive matrix type display portion is suitable for the area color type display device. The display device can display mainly texts or symbols.

Then, a second electrode 137 is formed. The second electrode 137 serving as an anode of the light emitting element is formed of a light transmissive conductive film, for example, a light-transmissive conductive film such as ITO, ITSO, or a film obtained by mixing indium oxide with zinc oxide (ZnO) by 2 to 20%. The light emitting element has a structure in which the layer 136 containing an organic compound is interposed between the first electrode 130 and the second electrode 137. A material for the first electrode 130 and the second electrode 137 is required to be selected in consideration of a work function. Either of the first electrode 130 or the second electrode 137 can be an anode or a cathode depending on a pixel structure.

The light emitting element formed by the foregoing materials emits light under forward bias. A pixel of a display device formed by using the light emitting element can drive by either a passive matrix (also referred to as a simple matrix) driving method or an active matrix driving method. At any rate, each pixel emits light by applying forward bias at a certain timing. Further, the respective pixels are in non-light emission state for a certain period. The reliability of the light emitting element can be improved by applying reverse bias in the non-light emission state. The light emitting element may be in a deterioration mode in which emission intensity decreases under a certain driving condition or may be in a deterioration mode in which apparent luminance decreases due to the expansion of a non-light emission region within the pixel. The deterioration can be delayed by alternating current (AC) driving to apply forward bias and reverse bias, which leads to improve the reliability of the light emitting device.

In order to lower the resistance of the second electrode 137, an auxiliary electrode may be provided over the second electrode 137 which does not serve as a light emitting region. A protective film for protecting the second electrode 137 may be formed as well. For example, a protective film composed of a silicon nitride can be formed by using a disc-form target formed of silicon in a deposition chamber of nitrogen atmosphere or atmosphere including nitrogen and argon. Further, a thin film containing carbon as a main component (a DLC film, a CN film, or an amorphous carbon film) can be formed as the protective film and other deposition chamber using chemical vapor deposition (hereinafter referred to as CVD) method may be provided additionally. A diamond like carbon film (also referred to as a DLC film) can be formed by plasma CVD method (typically, RF plasma CVD method, microwave CVD method, electron cyclotron resonance (ECR) CVD method, heat filament CVD method, or the like), a combustion-flame method, a sputtering method, an ion beam deposition method, a laser deposition method, or the like. A hydrogen gas and a hydrocarbon gas ($CH_4$, $C_2H_2$, $C_6H_6$, or the like) are used as a reaction gas for deposition. The reaction gases are ionized by glow discharge, and the ions are accelerated to collide with a cathode applied with negative self-bias, then, the DLC film is deposited. Further, the carbon nitride film (also referred to as a CN film) may be formed by using a $C_2H_4$ gas and a $N_2$ gas as reaction gases. In addition, the DLC film and the CN film are insulating films transparent or semitransparent to visible light. The term "transparent to visible light" means having a transmittance of 80 to 100% for visible light. The term "semitransparent to visible light" means having a transmittance of 50 to 80% for visible light. The protective film is not necessarily provided.

Then, the sealing substrate 135 is attached by sealant (not shown) to seal the light emitting element. The space surrounded by the sealant is filled with a light-transmissive filler 138. The filler 138 is not particularly limited as long as it transmits light. Representatively, an ultraviolet ray curable or heat curable epoxy resin may be used. Here, a high heat-resistant UV epoxy resin (manufactured by Electrolyte Cooperation: 2500 Clear) having refractivity of 1.50, viscosity of 500 cps, shore D hardness of 90, tensile intensity of 3000 psi, Tg point of 150° C., volume resistance of $1\times10^{15}$ O·cm, withstand voltage of 450 V/mil is used. By filling the filler 138 between a pair of substrates, the transmittance can be improved as a whole.

At last, an FPC 146 is attached to the terminal electrode 141 by an anisotropic conductive film 145 by a known method (see FIG. 9D). In this manner, an active matrix light emitting device can be manufactured.

Figure 11:
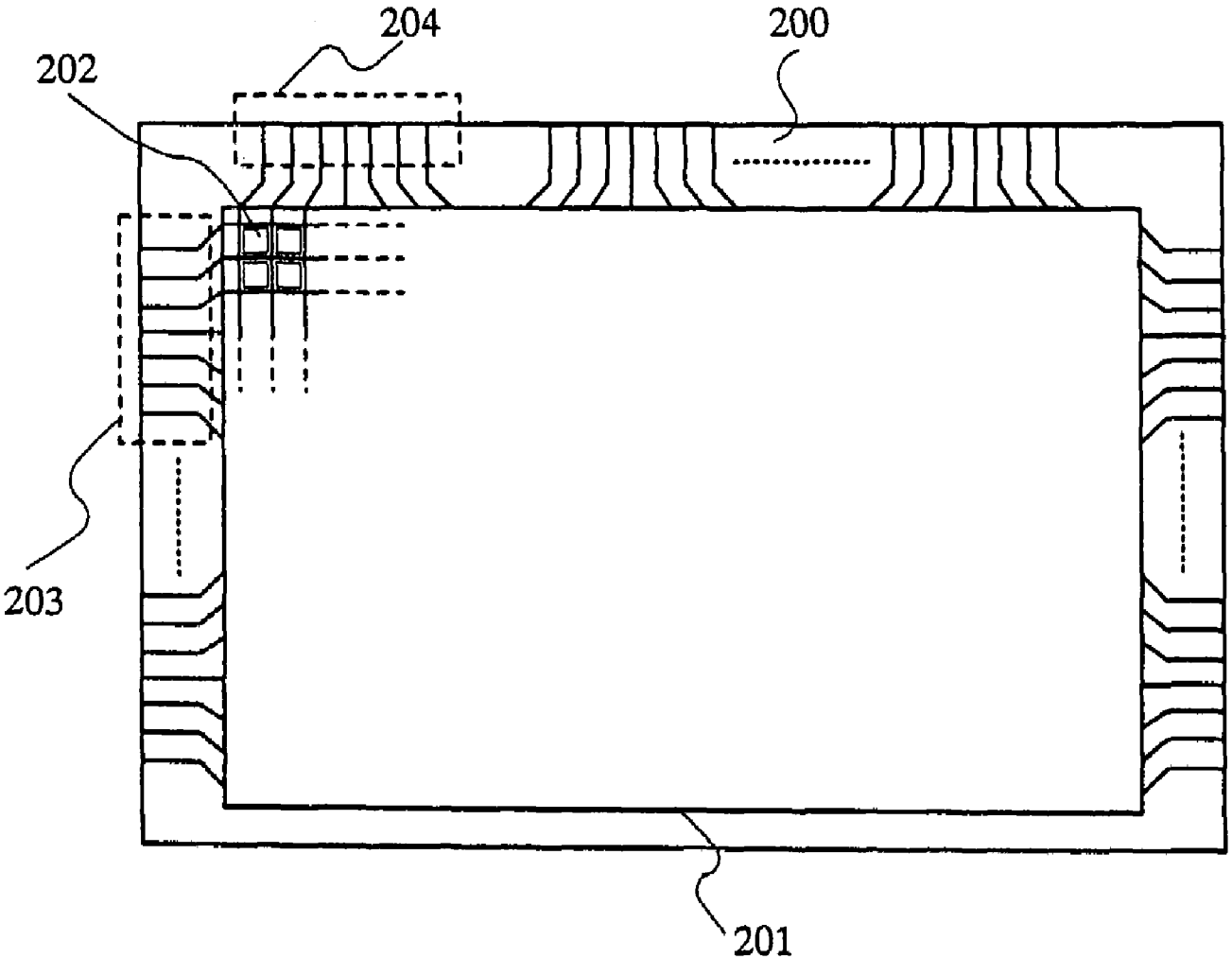
FIG. 11 is a diagram showing an EL display module according to one embodiment mode.

FIG. 11 is a top view showing an example of a structure of an EL display panel. FIG. 11 shows a structure of a light emitting display panel which controls a signal to be inputted to a scan line and a signal line by an external driver circuit. A pixel portion 201 in which a pixel 202 is arranged in matrix, a scan line input terminal 203, and a signal line input terminal 204 are formed over a substrate 200 having an insulating surface. The number of pixels may be set according to various specifications, for example, 1024×768×3 (RGB) for XGA, 1600×1200×3 (RGB) for UXGA, or 1920×1080×3 (RGB) in the case of a full spec high vision.

The pixels 202 are arranged in matrix with scan lines extending from the scan line input terminal 203 and signal lines extending from the signal line input terminal 204 crossing each other. Each of the pixels 202 is provided with a switching element and a pixel electrode connected thereto. A typical example of the switching element is a TFT. Each of the pixels can be independently controlled by signals inputted externally as a gate electrode of the TFT is connected to the scan line and a source or drain electrode is connected to the signal line.

In the case of forming the first electrode 130 shown in FIGS. 9A to 9D by a light transmissive material and forming the second electrode 137 by a metal material, a structure of emitting light through the substrate 100, that is a bottom emission type is formed. Alternatively, in case of forming the first electrode 130 by a metal material and forming the second electrode 137 by a light transmissive material, a structure of emitting light through the sealing substrate 135, that is a top emission type is formed. Moreover, in the case of forming the first electrode 130 and the second electrodes 137 by light transmissive materials, a structure of emitting light through both of the substrate 100 and the sealing substrate 135 can be formed. The invention may appropriately adopt any one of the aforementioned structures. Further, a driver circuit may be mounted in the EL display panel. One mode thereof is described with reference to FIG. 12.

Figure 12:
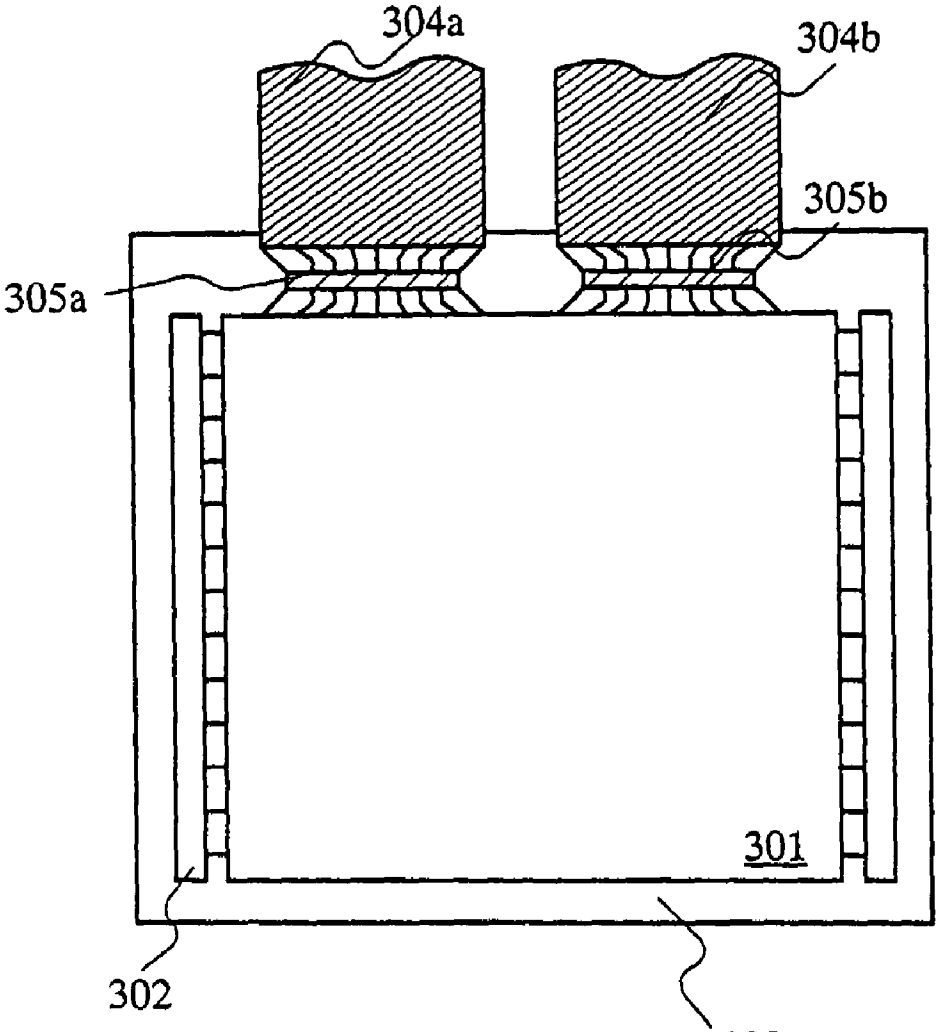
FIG. 12 is a diagram showing an EL display module according to one embodiment mode.

First, a display device employing a COG method is described with reference to FIG. 12. A pixel portion 301 for displaying data such as texts and images and a scan driver circuit 302 are provided over a substrate 300. A substrate provided with a plurality of driver circuits is divided into rectangles, and the divided driver circuits (hereinafter referred to as driver ICs) 305*a* and 305*b* are mounted on the substrate 300. FIG. 12 shows a mode of mounting a plurality of driver ICs 305*a* and 305*b* and tapes 304*a* and 304*b* at the end of the driver ICs 305*a* and 305*b*. In addition, a divided size may be almost the same as the length of a side of the pixel portion on a signal line side, and a tape may be mounted at the end of a single driver IC.

A TAB method may be adopted, in which case a plurality of tapes may be attached, on which a driver IC may be mounted. Similarly to the case of the COG method, a single driver IC may be mounted on a single tape, in which case a metal piece or the like for fixing the driver IC may be attached by strength problems.

A plurality of the driver ICs to be mounted on an EL display panel are preferably formed over a rectangular substrate having a side of 300 to 1000 mm or longer in view of improving productivity. In other words, a plurality of circuit patterns including a driver circuit portion and an input/output terminal as a unit are formed over the substrate, and may be finally divided and taken out. In consideration of the side length of the pixel portion and the pixel pitch, the driver IC may be formed to be a rectangle having a long side of 15 to 80 mm and a short side of 1 to 6 mm. Alternatively, the driver IC may be formed to have a side length that the side length of the pixel region or the pixel portion is added to the side length of each driver circuit.

In terms of external dimension, a driver IC is more advantageous than an IC chip in length of a long side. When a driver IC having a long side of 15 to 80 mm is used, the less number thereof is required to be mounted in accordance with the pixel portion than the case of using an IC chip. Therefore, a manufacturing yield can be improved. When a driver IC is formed over a glass substrate, productivity does not fall as a mother substrate is not limited in shape. This is a great advantage as compared with the case of taking IC chips out of a circular silicon wafer.

In FIG. 12, the driver ICs 305*a* and 305*b* each provided with a driver circuit are mounted in a region outside the pixel portion 301. The driver ICs 305*a* and 305*b* are driver circuits of signal line sides. In order to form a pixel portion corresponding to RGB full color, 3072 signal lines are required for XGA and 4800 signal lines are required for UXGA. The signal lines formed in such numbers are divided into several blocks on an edge of the pixel portion 301 and are provided with leading lines. The leading lines are gathered in relation to pitches of output terminals of the driver ICs 305*a* and 305*b*.

The driver IC is preferably formed of a crystalline semiconductor formed over a substrate. The crystalline semiconductor is preferably formed by being irradiated with continuous wave laser light. Therefore, a continuous wave solid laser or gas laser is used as an oscillator for generating the laser light. There are few crystal defects when a continuous wave laser is used, and as a result, a transistor can be formed by using a polycrystalline semiconductor layer with a large grain size. In addition, high-speed driving is possible since mobility and response are favorable, and it is possible to further improve an operating frequency of an element than that of the conventional element. Therefore, high reliability can be obtained since there are few characteristics variations. Note that a channel-length direction of a transistor and a scanning direction of laser light may be preferably the same to further improve an operating frequency. This is because the highest mobility can be obtained when a channel length direction of a transistor and a scanning direction of laser light with respect to a substrate are almost parallel (preferably, from −30° to 30°) in a laser crystallization step by a continuous wave laser. The channel length direction coincides with a flowing direction of a current, in other words, a direction in which a charge moves in a channel formation region. The transistor manufactured in this manner has an active layer including a polycrystalline semiconductor layer in which a crystal grain extends in a channel direction, and this means that a crystal grain boundary is formed almost along a channel direction.

In order to perform laser crystallization, it is preferable to largely narrow down the laser light, and a beam spot thereof preferably has the same width as that of a short side of the driver IC, which is approximately from 1 to 3 mm. In addition, in order to obtain an enough and effective energy density for an object to be irradiated, an irradiation region of the laser light is preferably in a linear shape. A linear shape here does not refer to a line in a strict sense but refers to a rectangle or an oblong shape with a large aspect ratio, for example, an aspect ratio of 2 or higher (preferably from 10 to 10000). Thus, it is possible to provide a manufacturing method of a display device in which productivity is improved by making a beam spot width of the laser light the same as that of a short side length of the driver IC.

FIG. 12 shows a mode in which the scan line driver circuit is integrated with the pixel portion and the driver IC is mounted as the signal line driver circuit. However, the invention is not limited to this and the driver ICs may be mounted as both the scan line driver circuit and the signal line driver circuit. In that case, it is preferable that specifications of the driver ICs to be used on the scan line side and on the signal line side be different.

In the pixel portion 301, the signal line and the scan line intersect to form a matrix and a transistor is arranged at each intersection. A TFT having an amorphous semiconductor or a semi-amorphous semiconductor as a channel portion is used as the transistor arranged in the pixel portion 301 in the invention. The amorphous semiconductor is formed by a plasma CVD method, a sputtering method, or the like. The semi-amorphous semiconductor can be formed at a temperature of 300° C. or lower by a plasma CVD method. A film thickness necessary to form a transistor is formed in a short time even in the case of a non-alkaline glass substrate of an external size of, for example, 550×650 mm. The feature of such a manufacturing technique is effective in manufacturing a large-area display device. In addition, a semi-amorphous TFT can obtain field effect mobility of 2 to 10 $cm^2/V\cdot sec$ by forming a channel formation region of an SAS. Therefore, this TFT can be used as a switching element of pixel and as an element constituting the driver circuit of a scan line side. Thus, an EL display panel in which system-on-panel is realized can be manufactured.

Note that FIG. 12 is shown on the premise that the scan line driver circuit is also integrated over the substrate by using a TFT having a semiconductor layer formed of a semi-amorphous semiconductor (SAS). In the case of using a TFT having a semiconductor layer formed of a semi-amorphous semiconductor, a driver IC may be mounted as both the scan line driver circuit and the signal line driver circuit.

In that case, it is preferable that specifications of the driver ICs to be used on the scan line side and on the signal line side be different. For example, a transistor constituting the scan line driver IC is required to withstand a voltage of approximately 30 V, however, a driving frequency is 100 kHz or less, thus a high-speed operation is not required much. Therefore, it is preferable to set the channel length (L) of the transistor included in the scan line driver sufficiently long. On the other hand, a transistor of the signal line driver IC is required to withstand a voltage of approximately 12 V, however, a driving frequency is around 65 MHz at 3 V, thus a high speed operation is required. Therefore, it is preferable to set the channel length or the like of the transistor included in a driver based on a micron rule.

A method for mounting a driver IC is not particularly limited and a known method such as a COG method, a wire bonding method, or a TAB method can be employed. The height between the driver IC and the opposing substrate can be made almost the same by forming the driver IC to have the same thickness as that of the opposing substrate, which contributes to form a thinner display device as a whole. When both substrates are formed of the same material, thermal stress is not generated and characteristics of a circuit including a TFT are not damaged even when temperature changes in the display device. Furthermore, the number of driver ICs to be mounted on one pixel region can be reduced by mounting a longer driver IC as a driver circuit than an IC chip as described in this embodiment mode.

As described above, a fine pattern can be formed by exposing a conductive pattern formed by droplet discharge method with laser light and developing it. Moreover, by forming various patterns directly on a substrate by droplet discharge method, an EL display panel can be easily formed even by using a glass substrate of the fifth generation or later having a side of 1000 mm or longer.

Further, in this embodiment mode, a step in which a spin coating is not performed and an exposure step using a photo mask are not performed as much as possible is shown, however, the invention is not limited to this. An exposure step in which a photo mask is used as a part of patterning may be performed as well.

Various electronic devices can be formed by using an EL display panel manufactured as described above. Examples of the electronic devices include a television device, a video camera, a digital camera, a goggle type display, a navigation system, an audio reproducing device (a car audio set, an audio component system and the like), a personal computer, a game machine, a portable information terminal (a mobile computer, a portable phone, a portable game machine, an electronic book, or the like), an image reproducing device provided with a recording medium (specifically, a device which reproduces a recording medium such as a Digital Versatile Disc (DVD) and is provided with a display capable of displaying the reproduced image) and the like. In particular, it is preferable to apply the invention to a large television device with a large screen. Specific examples of these electronic devices are shown in FIGS. 16A to 16D.

Figure 16A:
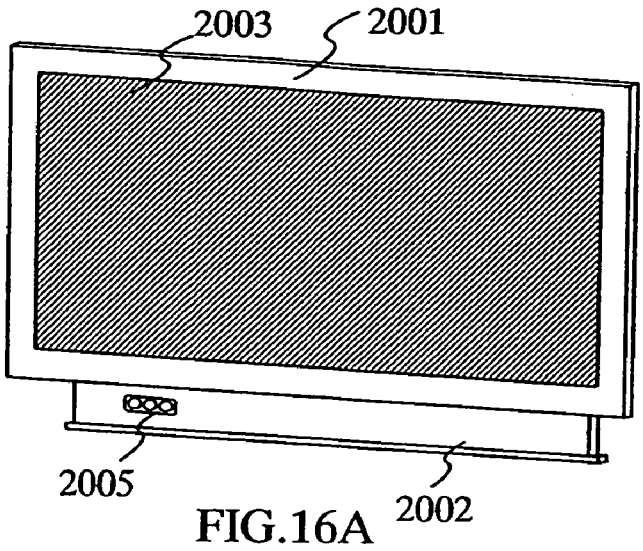
FIGS. 16A to 16D are views of examples of electronic devices.

FIG. 16A illustrates a large television device having a large screen of 22 to 50 inches, which includes a housing 2001, a support base 2002, a display portion 2003, a video input terminal 2005 and the like. The display device includes all display devices for displaying information such as for receiving television broadcast, and interactive television. According to the invention, a relatively inexpensive large display device can be realized even by using a glass substrate of the fifth generation or later having a side of 1000 mm or longer.

Figure 16B:
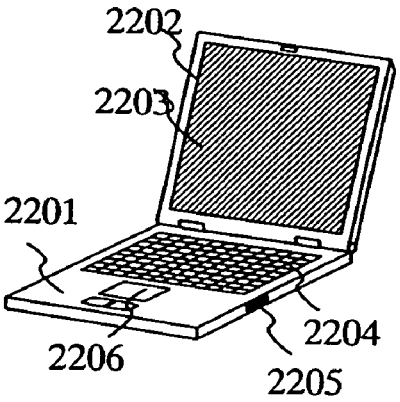

FIG. 16B illustrates a personal computer including a main body 2201, a housing 2202, a display portion 2203, a keyboard 2204, an external connecting port 2205, a pointing mouse 2206 and the like. According to the invention, a relatively inexpensive laptop personal computer can be realized.

Figure 16C:
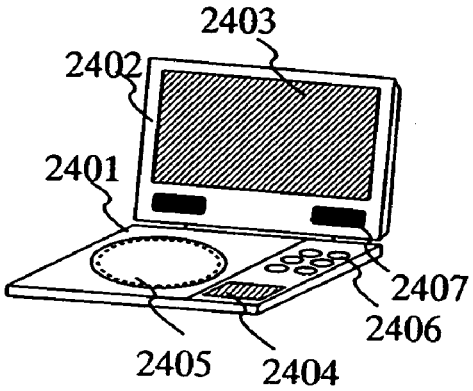

FIG. 16C illustrates a portable image reproducing device provided with a recording medium (specifically, a DVD reproducing device), including a main body 2401, a housing 2402, a display portion A 2403, a display portion B 2404, a recording medium (DVD and the like) reading portion 2405, an operating key 2406, a speaker portion 2407 and the like. The display portion A 2403 mainly displays image data while the display portion B 2404 mainly displays text data. It is to be noted that the image reproducing device provided with a recording medium includes a home game machine and the like. According to the invention, a relatively inexpensive image reproducing device can be realized.

Figure 16D:
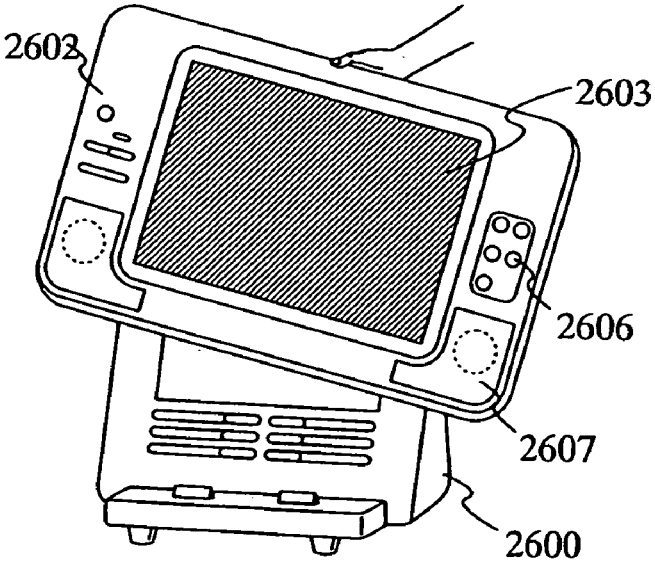

FIG. 16D illustrates a television device having a portable and wireless display. A housing 2602 includes a battery and a signal receiver. The battery drives a display portion 2603 and a speaker portion 2607. The battery is rechargeable by a charger 2600. Moreover, the charger 2600 can send and receive a video signal and transmit it to the signal receiver of the display. The housing 2602 is controlled by an operating key 2606. The device shown in FIG. 16D can be used for a video/audio interactive communication device since a signal can be transmitted from the housing 2602 to the charger 2600 by operating the operating key 2606. By operating the operating key 2606, a signal is transmitted from the housing 2602 to the charger 2600 and then a signal which the charger 2600 can transmit is received by another electronic device, thereby communication of another electronic device can be controlled. Thus, it can also be used as a general remote control device. According to the invention, a relatively large (22 to 50 inches) portable television can be provided by an inexpensive manufacturing process.

As described above, the light emitting device according to the invention can be used as a display portion of various electronic devices. It is to be noted that a TFT is formed of amorphous silicon or semi-amorphous silicon in this embodiment mode, however, the invention is not limited to this. Similar operation effects can be obtained by applying a TFT of which channel forming region is formed of a polysilicon material.

EMBODIMENT MODE 8

In this embodiment mode, a light emitting device having a thin film transistor is described with reference to FIGS. 14A to 14C.

Figure 14A:
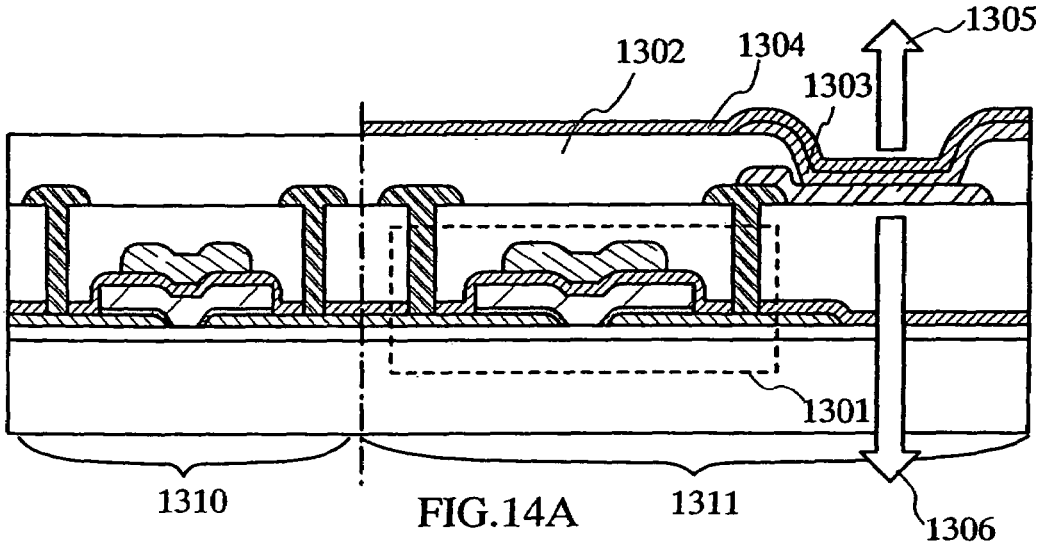
FIGS. 14A to 14C are sectional diagrams showing a structure of an EL display panel according to one embodiment mode.

As shown in FIG. 14A, a top gate N-channel TFT having an active layer formed of a semi-amorphous silicon film is provided in a driver circuit portion 1310 and a pixel portion 1311.

In this embodiment mode, an N-channel TFT connected to a light emitting element formed in the pixel portion 1311 is referred to as a driving TFT 1301. An insulating film 1302 called a bank or a partition wall is formed so as to cover an end of an electrode (referred to as a first electrode) of the driving TFT 1301. For the insulating film 1302, an inorganic material (silicon oxide, silicon nitride, silicon oxynitride and the like), a photosensitive or non-photosensitive organic material (polyimide, acrylic, polyamide, polyimide amide, resist, or benzocyclobutene), a material having a back bone structure of Si—O bond and containing at least hydrogen or at least one of fluoride, an alkyl group, or aromatic carbon hydride as a substituent, that is a so-called siloxane, and a stacked-layer structure of these can be used. As an organic material, a positive type photosensitive organic resin or a negative type photosensitive organic resin can be used.

An aperture portion is formed in the insulating film 1302 over the first electrode. An electroluminescent layer 1303 is formed in the aperture portion, and a second electrode 1304 of a light emitting element is provided so as to cover the electroluminescent layer and the insulating film 1302. Note that a singlet excited state and a triplet excited state can be given as a kind of a molecular exciton generated in the electroluminescent layer. A ground state is normally a singlet state; therefore, luminescence from a singlet excited state is referred to as fluorescence and luminescence from a triplet excited state is referred to as phosphorescence. Luminescence from the electroluminescent layer includes the case where either excited state contributes. In addition, fluorescence and phosphorescence can be used in combination, and can be selected in accordance with a luminescence property (such as luminance or life) of each RGB.

The electroluminescent layer 1303 is formed by sequentially stacking an HTL (hole injecting layer), an HTL (hole transporting layer), an EML (emission layer), an ETL (electron transporting layer), and an EIL (electron injecting layer) in this order from the first electrode side. Note that the electroluminescent layer can have a single layer structure or a mixed structure as well as a stacked-layer structure.

In the case of a full color display, a material which exhibits light of red (R), green (G), and blue (B) may be selectively formed as the electroluminescent layer 1303 by an ink-jet method, an evaporation method using an evaporation mask for each, or the like. Specifically, CuPc or PEDOT is used as the HIL; a-NPD as the HTL; BCP or $Alq_3$ as the ETL; and BCP:Li or $CaF_2$ as the EIL. In addition, $Alq_3$ doped with a dopant in accordance with the respective colors of R, G, and B (DCM or the like in the case of R, and DMQD or the like in the case of G) may be used as the EML, for example. Note that the electroluminescent layer is not limited to a material having the aforementioned stacked-layer structure. For example, a hole injection property can be enhanced by co-evaporating oxide such as molybdenum oxide ($MoO_x$: x=2 to 3) and a-NPD or rubrene. An organic material (including a low molecular weight material or a high molecular weight material) or a composite material of an organic material and an inorganic material can be used as the material.

In the case of forming an electroluminescent layer which emits white light, a full color display may be performed by separately providing a color filter or a color filter and a color conversion layer, and the like. The color filter and the color conversion layer may be formed on a second substrate (sealing substrate) before being attached. The color filter or the color conversion layer can be formed by ink-jet method. It is needless to say that monochrome light emitting device may be formed by forming an electroluminescent layer which exhibits light emission except white. In addition, an area color type display device which can perform monochrome display may be formed.

The first electrode and the second electrode 1304 are required to be formed of a material selected in consideration of a work function. However, the first and second electrodes can be either an anode or a cathode depending on a pixel configuration. In this embodiment mode, it is preferable that the first electrode be a cathode and the second electrode be an anode as the driving TFT is an N-channel transistor. In the case where the driving TFT polarity is a P-channel type, the first electrode is preferably an anode and the second electrode is preferably a cathode.

In consideration of a moving direction of electrons of the driving TFT as an N-channel transistor, the first electrode as a cathode, an ETL (electron injecting layer), an ETL (electron transporting layer), an EML (light emitting layer), an HTL (hole transporting layer), an HIL (hole injecting layer), and the second electrode as an anode are preferably stacked sequentially.

As a passivation film for covering the second electrode, an insulating film is preferably formed of DLC or the like by sputtering or CVD method. As a result, moisture or oxygen can be prevented from penetrating. Further, moisture or oxygen can be prevented from penetrating by covering the side of a display device with the first electrode, the second electrode, or another electrode. Then, the sealing substrates is attached. The space formed by the sealing substrate may be filled with nitrogen or further provided with a drying agent. The space formed by the sealing substrate may be filled with resin having a light-emitting property and a high moisture absorption property.

To increase contrast, a polarizer or a circular polarizer may be provided. For example, a polarizer or a circular polarizer can be provided over one surface or both surfaces of the display.

In the light emitting device having the structure formed as described above, a material having a light transmissive property (ITO or ITSO) is used for the first electrode and the second electrode. Therefore, light is emitted from the electroluminescent layer to both directions 1305 and 1306 at luminance corresponding to a video signal inputted from a signal line. Further, FIG. 14B shows a structure example which is partly different than FIG. 14A.

Figure 14B:
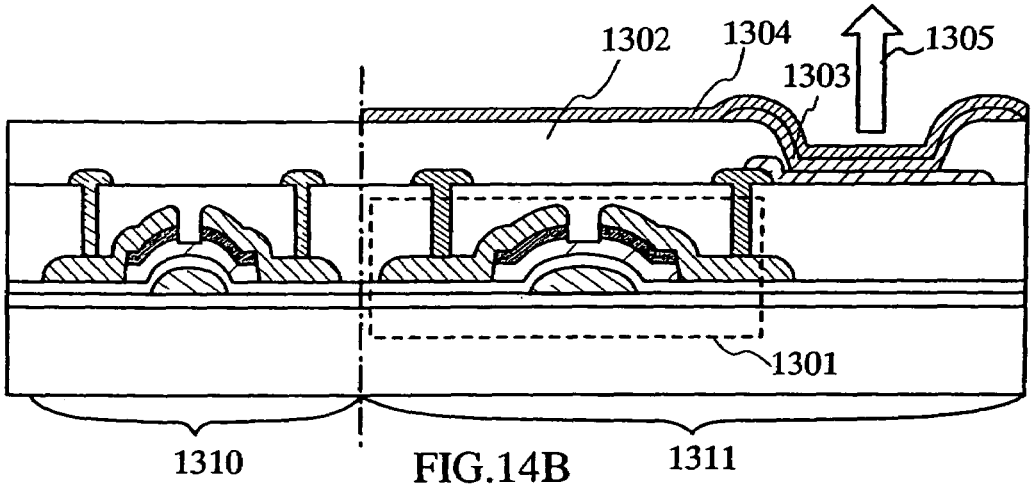

In the structure of a light emitting device illustrated in FIG. 14B, a channel etch N-channel TFT is provided in the driver circuit portion 1310 and the pixel portion 1311. A manufacturing method of this channel etch TFT is described in Embodiment Mode 4, therefore, a detailed description thereon is omitted here.

Similarly to FIG. 14A, an N-channel TFT connected to a light emitting element formed in the pixel portion 1311 is denoted as a driving TFT 1301. The structure illustrated in FIG. 14B is different than FIG. 14A in that the first electrode is formed of a conductive film having a non-light transmissive property and preferably a highly reflective film, and the second electrode 1304 is formed of a conductive film having a light transmissive property. Therefore, a light emitting direction 1305 is only to the sealing substrate side. FIG. 14C shows a structure example which is partly different than FIG. 14A.

Figure 14C:
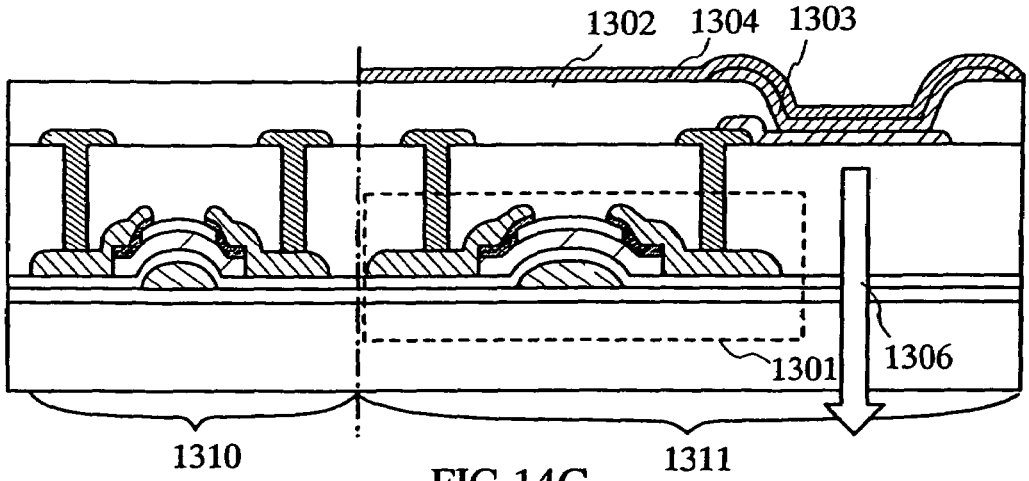

In a structure of a light emitting device shown in FIG. 14C, a channel stop N-channel TFT is provided for the driver circuit portion 1310 and the pixel portion 1311. A manufacturing method of the channel stop N-channel TFT is described in Embodiment Mode 5, therefore, a detailed description thereon is omitted here.

Similarly to FIG. 14A, an N-channel TFT connected to a light emitting element formed in the pixel portion 1311 is denoted to as the driving TFT 1301. The structure shown in FIG. 14C is different than FIG. 14A in that the first electrode is formed of a conductive film having a light transmissive property, and the second electrode 1304 is formed of a conductive film having a non-light transmissive property and preferably a highly reflective film. Therefore, a light emitting direction 1306 is only to the substrate side.

The structure of a light emitting device using each thin film transistor has been described. The structure of the thin film transistor and the structure of the light emitting device can be freely combined with each other.

This application is based on Japanese Patent Application serial no. 2004-180306 filed in Japan Patent Office on May 22, 2004, the contents of which are hereby incorporated by reference.

What is claimed is:

1. A display device comprising:

a first transistor including a drain terminal and a source terminal;

a second transistor including a drain terminal and a source terminal;

an amplifier circuit including an input terminal and an output terminal; and a current source circuit, wherein the drain terminal of the first transistor is electrically connected to the drain terminal of the second transistor, wherein the source terminal of the first transistor is electrically connected to a first electrode of a first light emitting element, wherein the source terminal of the second transistor is electrically connected to a first electrode of a second light emitting element, wherein a second electrode of the second light emitting element is electrically connected to the input terminal of the amplifier circuit, wherein the second electrode of the second light emitting element is electrically connected to the current source circuit, and wherein a second electrode of the first light emitting element is electrically connected to the output terminal of the amplifier circuit.

2. The display device according to claim 1, wherein the first transistor and the second transistor is an N-channel transistor.

3. The display device according to claim 1, wherein the first transistor and the second transistor each has a channel forming region formed of an amorphous semiconductor film.

4. The display device according to claim 1, wherein the first transistor and the second transistor each has a channel forming region formed of a semi-amorphous semiconductor film.

5. The display device according to claim 1, wherein the first light emitting element and the second light emitting element are EL elements.

6. The display device according to claim 1, wherein the display device is incorporated in an electronic device selected from the group consisting of a television device, a personal computer, and a portable image reproducing device.

7. A display device comprising:

a first transistor including a source terminal and a gate terminal;

a second transistor including a source terminal, a gate terminal, and a drain terminal;

an amplifier circuit including an input terminal and an output terminal;

a current source circuit; and a video signal generating circuit including an output terminal and an input terminal, wherein the source terminal of the first transistor is electrically connected to a first electrode of a first light emitting element, wherein the source terminal of the second transistor is electrically connected to a first electrode of a second light emitting element, wherein a gate terminal of the second transistor is electrically connected to the drain terminal of the second transistor, wherein the drain terminal of the second transistor is electrically connected to the input terminal of the amplifier circuit, wherein the drain terminal of the second transistor electrically connected to the current source circuit, wherein a second electrode of the first light emitting element is electrically connected to a second electrode of the second light emitting element, wherein the gate terminal of the first transistor is electrically connected to the output terminal of the video signal generating circuit, and wherein the output terminal of the amplifier circuit is electrically connected to the input terminal of the video signal generating circuit.

8. The display device according to claim 7, wherein the first transistor and the second transistor is an N-channel transistor.

9. The display device according to claim 7, wherein the first transistor and the second transistor each has a channel forming region formed of an amorphous semiconductor film.

10. The display device according to claim 7, wherein the first transistor and the second transistor each has a channel forming region formed of a semi-amorphous semiconductor film.

11. The display device according to claim 7, wherein the first light emitting element and the second light emitting element are EL elements.

12. The display device according to claim 7, wherein the display device is incorporated in an electronic device selected from the group consisting of a television device, a personal computer, and a portable image reproducing device.

13. A display device comprising:

a first transistor including a source terminal and a drain terminal;

a second transistor including a source terminal and a drain terminal;

an amplifier circuit including an input terminal and an output terminal; and a current source circuit, wherein the source terminal of the first transistor is electrically connected to a first electrode of a first light emitting element, wherein the source terminal of the second transistor is electrically connected to a first electrode of a second light emitting element, wherein the drain terminal of the second transistor is electrically connected to the input terminal of the amplifier circuit, wherein the drain terminal of the second transistor is electrically connected to the current source circuit, wherein a second electrode of the first light emitting element is electrically connected to a second electrode of the second light emitting element, and wherein the output terminal of the amplifier circuit is electrically connected to the drain terminal of the first transistor.

14. The display device according to claim 13, wherein the first transistor and the second transistor is an N-channel transistor.

15. The display device according to claim 13, wherein the first light emitting element and the second light emitting element are EL elements.

16. The display device according to claim 13, wherein the display device is incorporated in an electronic device selected from the group consisting of a television device, a personal computer, and a portable image reproducing device.

17. The display device according to claim 13, wherein the first transistor and the second transistor each has a channel forming region formed of an amorphous semiconductor film.

18. The display device according to claim 13, wherein the first transistor and the second transistor each has a channel forming region formed of a semi-amorphous semiconductor film.

19. A display device comprising:

a first transistor including a source terminal and a drain terminal;

a second transistor including a source terminal and a drain terminal;

a first light emitting element including a first electrode and a second electrode;

a second light emitting element including a first electrode and a second electrode;

an amplifier circuit including an input terminal and an output terminal; and a current source circuit, wherein the drain terminal of the first transistor is electrically connected to the drain terminal of the second transistor, wherein the source terminal of the first transistor is electrically connected to the first electrode of the first light emitting element, wherein the source terminal of the second transistor is electrically connected to the first electrode of the second light emitting element, wherein the second electrode of the second light emitting element is electrically connected to the input terminal of the amplifier circuit, wherein the second electrode of the second light emitting element is electrically connected to the current source circuit, wherein the second electrode of the first light emitting element is electrically connected to the output terminal of the amplifier circuit, and wherein the amplifier circuit comprises a voltage follower circuit.

20. The display device according to claim 19, wherein the first transistor and the second transistor each has a channel forming region formed of a semi-amorphous semiconductor film.

21. The display device according to claim 19, wherein the first transistor and the second transistor is an N-channel transistor.

22. The display device according to claim 19, wherein the first transistor and the second transistor each has a channel forming region formed of an amorphous semiconductor film.

23. The display device according to claim 19, wherein the first light emitting element and the second light emitting element are EL elements.

24. The display device according to claim 19, wherein the display device is incorporated in an electronic device selected from the group consisting of a television device, a personal computer, and a portable image reproducing device.

25. A display device comprising:

a first transistor including a source terminal and a gate terminal;

a second transistor including a drain terminal, a source terminal, and a gate terminal;

a first light emitting element including a first electrode and a second electrode;

a second light emitting element including a first electrode and a second electrode;

an amplifier circuit including an input circuit and an output circuit;

a current source circuit; and a video signal generating circuit including an output terminal and an input terminal, wherein the source terminal of the first transistor is electrically connected to the first electrode of the first light emitting element, wherein the source terminal of the second transistor is electrically connected to the first electrode of the second light emitting element, wherein the gate terminal of the second transistor is electrically connected to the drain terminal of the second transistor, wherein the drain terminal of the second transistor is electrically connected to the input terminal of the amplifier circuit, wherein the drain terminal of the second transistor is electrically connected to the current source circuit, wherein the second electrode of the first light emitting element is electrically connected to the second electrode of the second light emitting element, wherein the gate terminal of the first transistor is electrically connected to the output terminal of the video signal generating circuit, wherein the output terminal of the amplifier circuit is electrically connected to the input terminal of the video signal generating circuit, and wherein the amplifier circuit comprises a voltage follower circuit.

26. The display device according to claim 25, wherein the first transistor and the second transistor is an N-channel transistor.

27. The display device according to claim 25, wherein the first transistor and the second transistor each has a channel forming region formed of an amorphous semiconductor film.

28. The display device according to claim 25, wherein the first transistor and the second transistor each has a channel forming region formed of a semi-amorphous semiconductor film.

29. The display device according to claim 25, wherein the first light emitting element and the second light emitting element are EL elements.

30. The display device according to claim 25, wherein the display device is incorporated in an electronic device selected from the group consisting of a television device, a personal computer, and a portable image reproducing device.

31. A display device comprising:

a first transistor including a source terminal and a drain terminal;

a second transistor including a source terminal and a drain terminal;

a first light emitting element including a first electrode and a second electrode;

a second light emitting element including a first electrode and a second electrode;

an amplifier circuit including an input terminal and an output terminal; and a current source circuit, wherein the source terminal of the first transistor is electrically connected to the first electrode of the first light emitting element, wherein the source terminal of the second transistor is electrically connected to the first electrode of the second light emitting element, wherein the drain terminal of the second transistor is electrically connected to the input terminal of an amplifier circuit, wherein the drain terminal of the second transistor is electrically connected to the current source circuit, wherein the second electrode of the first light emitting element is electrically connected to the second electrode of the second light emitting element, wherein the output terminal of the amplifier circuit is electrically connected to the drain terminal of the first transistor, and wherein the amplifier circuit comprises a voltage follower circuit.

32. The display device according to claim 31, wherein the first transistor and the second transistor is an N-channel transistor.

33. The display device according to claim 31, wherein the first transistor and the second transistor each has a channel forming region formed of an amorphous semiconductor film.

34. The display device according to claim 31, wherein the first transistor and the second transistor each has a channel forming region formed of a semi-amorphous semiconductor film.

35. The display device according to claim 31, wherein the first light emitting element and the second light emitting element are EL elements.

36. The display device according to claim 31, wherein the display device is incorporated in an electronic device selected from the group consisting of a television device, a personal computer, and a portable image reproducing device.

* * * * *